United States Patent [19]

Chen et al.

[11] 4,133,687

[45] Jan. 9, 1979

[54] PHOTOGRAPHIC ELEMENTS HAVING HYDROPHILIC COLLOID LAYERS CONTAINING COMPOUNDS HAVING ACTIVATOR PRECURSORS AND HYDROPHOBIC DEVELOPING AGENTS UNIFORMLY LOADED IN LATEX POLYMER PARTICLES

[75] Inventors: Tsang J. Chen; Donald F. McLaen, both of Rochester, N.Y.

[73] Assignee: Eastman Kodak Company, Rochester, N.Y.

[21] Appl. No.: 814,015

[22] Filed: Jul. 8, 1977

[51] Int. Cl.[2] ..... G03C 1/48; G03C 1/06; G03C 1/72; G03C 1/02

[52] U.S. Cl. ..... 96/76 R; 96/95; 96/114; 96/114.1

[58] Field of Search ..... 96/114, 114.1, 95, 76 R, 96/97

[56] References Cited

U.S. PATENT DOCUMENTS

| | | | |
|---|---|---|---|
| 2,772,163 | 11/1956 | Tong | 96/97 |
| 3,301,678 | 1/1967 | Humphlett et al. | 96/61 R |
| 3,518,088 | 6/1970 | Dunn et al. | 96/114 |
| 3,531,285 | 9/1970 | Haist et al. | 96/61 R |
| 3,619,195 | 11/1971 | Van Campen | 96/100 |
| 3,816,137 | 6/1974 | Gabrielsen et al. | 96/76 R |
| 4,060,420 | 11/1977 | Merkel et al. | 96/114.1 |

OTHER PUBLICATIONS

"Photographic Silver Halide . . . Systems", *Research Disclosure* #9232, 12/1971, pp. 107–110.

"Process for Achieving . . . Latex Compositions", Chen, *Research Disclosure,* No. 15930, 7/1977, pp. 62–74.

*Primary Examiner*—Richard L. Schilling

*Attorney, Agent, or Firm*—Richard E. Knapp

[57] ABSTRACT

A photographic element is disclosed having coated on a support a hydrophilic colloid layer containing an activator precursor and loaded polymer particles of from 0.02 to 0.2 micron in average diameter. The polymer particles consist essentially of a hydrophobic polymer of which at least 2 percent by weight is comprised of ionizable repeating units, at least half being cationically ionizable, and a hydrophobic developing agent present in a weight ratio to the polymer of from about 1:4 to 3:1. Silver halide is present in the hydrophilic colloid layer or in an adjacent layer, and the activator precursor is present in a concentration of from 1 to 4 equivalent for each mole of silver halide. The photographic element is capable of being thermally processed.

19 Claims, No Drawings

PHOTOGRAPHIC ELEMENTS HAVING HYDROPHILIC COLLOID LAYERS CONTAINING COMPOUNDS HAVING ACTIVATOR PRECURSORS AND HYDROPHOBIC DEVELOPING AGENTS UNIFORMLY LOADED IN LATEX POLYMER PARTICLES

This invention is directed to silver halide photographic elements of the type containing in a hydrophilic colloid layer an activator precursor and one or more hydrophobic photographic addenda, such as a hydrophobic silver halide developing agent.

Although many variant forms have been investigated, the overwhelming majority of silver halide photographic elements are characterized by a support having coated thereon one or more photographic emulsion layers each containing radiation-sensitive silver halide grains suspended in a hydrophilic colloid vehicle. Gelatin and combinations of gelatin with synthetic polymers are the most common hydrophilic colloid vehicles, although other materials, such as latexes have been contemplated. Illustrative hydrophilic colloid vehicles are set out in Paragraph VIII. Vehicles, *Product Licensing Index,* Vol. 92, December 1971, publication 9232, page 108 (published by Industrial Opportunities Ltd., Homewell, Havant, Hampshire, P09 1EF, UK).

Historically silver halide photographic elements have been most commonly processed by immersion in a developer composition containing a developing agent. Where the developing agent is hydrophilic in character, such as many polyhydroxybenzene developing agents, it is readily compatible with the hydrophilic colloid layers of the photographic element and can be readily incorporated therein. Incorporated hydrophilic developing agents work well under processing conditions which allow reaction products to be washed from the photographic element. Unfortunately, in a number of applications, such as image transfer photography and photothermography, it is not desirable to introduce a washing step in order to eliminate colored reaction products.

The incorporation of hydrophobic developing agents into hydrophilic colloid layers of silver halide photographic elements has been investigated in an effort to obtain high development activity and colorless or low-colored reaction products in those applications where the washing out of reaction products is not feasible or desirable. Humphlett et al. U.S. Pat. No. 3,301,678 issued Jan. 31, 1967; Haist et al. U.S. Pat. No. 3,531,285 issued Sept. 29, 1970; and Gabrielsen U.S. Pat. No. 3,816,137 issued June 11, 1974 are three examples of photographic elements containing incorporated hydrophobic developing agents in hydrophilic colloid layers.

The uniform distribution of hydrophilic addenda in hydrophilic colloid coating vehicles can normally be achieved by simple blending techniques, but when hydrophobic addenda are substituted, obtaining acceptable distributions of the addenda has required considerable investigation. One of the simplest techniques of dispersing hydrophobic addenda in hydrophilic colloid vehicles is to rely entirely on mechanical blending. According to this approach the hydrophobic addendum is simply blended into the hydrophilic colloid and the resulting mixture passed several times through a colloid mill. This technique produces inferior dispersions as compared to other conventional techniques. Further, the dispersions do not exhibit the degree of particle comminution and dispersion desired for many applications and are frequently unstable. Also, the heating inherent in milling can lead to chemical degradation. In a common variation on this approach the hydrophobic addendum (i.e. hydrophobe) is blended with what has been described as a "coupler solvent"—that is, an oleophilic high boiling solvent. Milling is then undertaken to disperse coupler solvent particles with the hydrophobe dissolved therein in the hydrophilic colloid. While this approach improves on direct mechanical blending, it retains to a degree its disadvantages and further introduces the disadvantage of adding to the hydrophilic colloid a substantial volume of coupler solvent, thereby undesirably increasing the bulk of the composition in comparison to the silver halide to be coated. In still another approach common to the incorporation of hydrophobic developing agents, they are first dissolved in an alcoholic or alkaline solvent and then blended into the hydrophilic colloid. Again, the increase of the bulk of the composition is not desirable.

Dunn and Smith U.S. Pat. No. 3,518,088 issued June 30, 1970, discloses one approach to loading a hydrophobic developing agent into a hydrophilic colloid vehicle for a photographic element while avoiding the photographic disadvantages of incorporating oily solvents such as coupler solvents. As indicated in Example 1, with reliance on colloid milling, polymer-developing agent particles of approximately 1 to 2 microns in diameter can be dispersed in the hydrophilic colloid to be coated.

Chen in commonly assigned U.S. Ser. Nos. 744,680 filed Nov. 24, 1976, now abandoned and 778,184 filed Mar. 16, 1977, discloses an unexpected and advantageous advance in the art of dispersing hydrophobes, including hydrophobic developing agents, in hydrophilic colloids for the purpose of obtaining improved silver halide photographic elements. According to the Chen teachings, here incorporated by reference, hydrophilic colloid layers for photographic elements can be prepared which contain polymer particles, obtained without milling, of an average diameter in the range of from 0.02 to 0.2 micron. (It should be noted that this is 1 to 2 orders of magnitude smaller than the particles of U.S. Pat. No. 3,518,088, Example 1 prepared with milling). Loaded into and distributed throughout the particles is a hydrophobe, such as a hydrophobic developing agent. The concentration of the hydrophobe in the polymer particles can be quite high. For example, the weight ratio of the hydrophobe to the loadable polymer can be from about 1:4 to 3:1. The unusually small particle sizes and their substantially uniform distribution in the hydrophilic colloid is achieved in part by employing a hydrophobic polymer having greater than about 2 percent by weight of the polymer derived from monomers capable of forming water soluble homopolymers. The polymer particles are initially prepared in the form of a latex and then loaded under conditions which favor loading (or ingestion) of the hydrophobe without coagulation or agglomeration of the latex particles.

One of the investigative aims leading to our invention was to develop an improved silver halide photographic element which can be thermally processed, also described herein as an improved photothermographic element. Such photographic elements are desirably processable without immersion in a bath, such as a developer solution. Accordingly, such photographic elements have in one form been characterized by at least one hydrophilic colloid layer containing a hydrophobic developing agent which forms colorless or minimally colored reaction products. The hydrophilic colloid layers also contain at least one equivalent of an activator precursor for each mole of silver halide present. The activator precursor is a compound which upon heating liberates a base, thereby increasing the pH of the layer containing the precursor so that development of the silver halide can commence. Although not essential, the hydrophilic colloid layers can also contain a stabilizer precursor. This is a compound which releases a moiety that prevents silver halide development in background (i.e. minimum density) areas and stabilizes the silver halide in the unexposed areas of the element. In a preferred form the same compound can be both an activator precursor and a stabilizer precursor (i.e. an activator-stabilizer precursor). The activator precursors are typically ionizable compounds which contain both a protonated basic nitrogen-containing moiety and an acid anion forming moiety. In addition to the patents of Humphlett et al., Haist et al. and Gabrielsen et al., cited above, illustrative preferred silver halide photographic elements containing incorporated hydrophobic developing agents and activator precursors are disclosed by Dickerson et al. U.S. Pat. No. 4,012,260 issued Mar. 15, 1977; Merkel et al. U.S. Ser. No. 712,459 filed Aug. 6, 1976, now U.S. Pat. No. 4,060,420; and Merkel U.S. Ser. No. 753,236 filed Dec. 22, 1976, each of which is commonly assigned with the present application to Eastman Kodak Company and the disclosures of which are here incorporated by reference.

Prior to our invention the teachings of Chen relating to the loading of hydrophobic developing agents had not been applied to preparing thermally processable photographic elements having hydrophilic colloid layers containing an activator precursor. In our own attempts to apply the teachings of Chen to the preparation of such thermally processable photographic elements we encountered repeated failure. We found that we could readily incorporate latex particles loaded with hydrophobic developing agents into hydrophilic colloid layers (both silver halide emulsion and overcoat colloid layers), but only if the activator precursor was not present in the same layer. Our attempts to introduce both the latex particles loaded with the developing agent and the activator precursor into the same layer resulted in coagulation or agglomeration of the latex particles. This was observed by the hydrophilic colloid layer taking on a milky or turbid appearance and containing large clumps of polymer so that we were unable to obtain uniform coatings. The turbid compositions did not exhibit the small particle sizes and uniform distributions characteristic of the Chen loading techniques and exhibited markedly inferior photographic properties.

Upon further investigation we successfully incorporated certain latex polymer particles loaded with hydrophobic developing agents into hydrophilic colloid layers also including an activator precursor. We attribute our success to discovering an advantageous and heretofore unappreciated relationship between the ionization characteristics of repeating units making up the polymers of the latex particles and the protonated basic nitrogen-containing moiety and acid anion which comprise the activator precursor compounds.

By reason of our success in introducing latex polymer particles loaded with hydrophobic developing agents into hydrophilic colloid layers containing activator precursors, we have made possible thermally processable photographic elements having a combination of desirable characteristics that has eluded those skilled in the art. We have achieved high dispersion uniformity of hydrophobic developing agents in hydrophilic colloid layers by loading the developing agents into particles of relatively small size as compared to those previously obtained in the art. Further, we have achieved this high degree of uniformity of dispersion without milling and its attendant disadvantages. By loading the developing agents into the polymer particles we are able to improve the shelf-life characteristics of the photographic elements. For example, we reduce tendencies toward silver halide fogging exhibited by some developing agents, and we protect the developing agent itself from aerial oxidation on keeping by loading it into the polymer particles. Since we do not have to resort to the use of alkaline solutions to introduce hydrophobic developing agents and since we can achieve a comparatively high weight ratio of developing agent to polymer, we are able to reduce the bulk of the hydrophilic colloid compositions to be coated. We thus avoid the photographically disadvantageous high bulk to silver halide ratios characteristic of prior art approaches to solvent loading. At the same time we retain the advantages of colorless or minimally colored developing agent reaction products. Still further, we are able to avoid the multiple coating of hydrophilic colloid layers which would be essential to incorporating incompatible latexes and activator precursors in a single photographic element.

In one aspect our invention is directed to a photographic element comprised of a support and, coated on the support, a hydrophilic colloid layer. The hydrophilic colloid layer is comprised of a hydrophilic colloid and, within the hydrophilic colloid, an activator precursor which is a compound of a protonated basic nitrogen containing moiety and an acid anion and loaded polymer particles of from 0.02 to 0.2 micron in average diameter. The loaded polymer particles consist essentially of a hydrophobic polymer of which at least 2 percent by weight is comprised of ionizable repeating units capable of forming hydrophilic homopolymers. At least half of the ionizable repeating units are cationically ionizable. A hydrophobic developing agent is loaded into and distributed through the polymer particles. The weight ratio of the developing agent to the polymer is from about 1:4 to 3:1. In the hydrophilic colloid layer or in an adjacent hydrophilic colloid layer radiation-sensitive silver halide grains are present. The activator precursor is present in a concentration of from 1 to 4 equivalents for each mole of the radiation sensitive silver halide.

DETAILED DESCRIPTION OF THE INVENTION

While subheadings are employed for convenience in describing our invention, it is intended that the disclosure be read and interpreted as a whole.

Hydrophobic Polymers

The photographic elements of our invention are made possible by the discovery of a composition for the polymer forming the particles to be loaded which renders them compatible when dispersed into a hydrophilic colloid layer with an activator precursor. To achieve a stable latex dispersion the composition of the polymer forming the particles is chosen to be predominantly hydrophobic. However, it is recognized that dispersion of the polymer in the form of latex particles in a hydrophilic colloid vehicle is facilitated if at least about 2 percent by weight of the polymer is made up of ionizable repeating units capable of forming hydrophilic homopolymers.

We have discovered quite unexpectedly that at least half (on a mole basis) of the hydrophilic homopolymer-forming ionizable repeating units from which the polymer is formed must be cationically ionizable. We have demonstrated that employing polymers in which cationically ionizable hydrophilic homopolymer-forming repeating units are absent results in coagulation of the polymer particles in hydrophilic colloid coating compositions when an activator precursor is also present.

Subject to the considerations stated above, any polymer which can be prepared in the form of a latex can be employed in our invention. If desired, the suitability of a particular latex for use in this invention can be verified by employing the screening test set out in each of the Chen patent applications cited above. To satisfy the Chen screening test, at 25° C., the loadable polymer particles being tested must (a) be capable of forming a latex with water at a polymer particle concentration of from 10 to 20 percent by weight, based on total weight of the latex, and (b) when 100 ml of the latex is then mixed with an equal volume of a water-miscible organic solvent, stirred and allowed to stand for 10 minutes, exhibit no observable coagulation of the polymer particles. This screening test is, of course, particularly suited to identifying polymers which in the form of latex particles are loadable with a hydrophobe according to the procedure taught by Chen.

In a preferred form the hydrophobic polymers to be employed in the form of latex particles and loaded with hydrophobic developing agent are formed of from 2 to 30, preferably 5 to 20, percent by weight of ionizable repeating uints which form hydrophilic homopolymers. At least half (or 50 percent), on a mole basis, of the ionizable repeating units are cationically ionizable. The ionizable repeating units are preferably entirely cationically ionizable. The remaining 70 to 98, preferably 80 to 95, percent by weight of the hydrophobic polymer is made up of repeating units which are nonionizable. Since the polymer as a whole must be hydrophobic, the nonionizable repeating units are entirely or predominantly chosen from among those that form hydrophobic homopolymers. When nonionizable repeating units are present which form hydrophilic homopolymers, they can be present in concentrations of up to 30 percent by weight. Unless otherwise stated, all of the weight percentages are based on total weight, in this instance the total weight of the hydrophobic polymer.

In a preferred form repeating units in the hydrophobic polymers are derived from cationically ionizable ethenic monomers having a molecular weight of less than 300. The repeating units can be represented by the following formula:

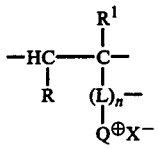

(I)

where

R and $R^1$ are independently chosen from among hydrogen, alkyl and aryl groups;

n is 0 or 1;

L is a divalent linking group, such as an alkylene, arylene, arylenealkylene,

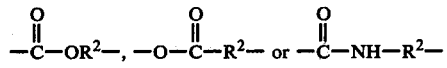

group, where $R^2$ is an alkylene, arylene or arylenealkylene group, or, taken in conjunction with R is a trivalent group of the formula

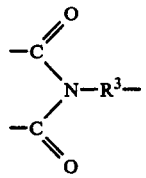

where $R^3$ is an alkylene group of from 1 to 4 carbon atoms or

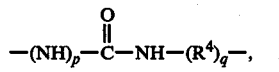

where $R^4$ is an alkylene group and p and q are either 0 or 1;

$Q^{\oplus}$ is a group of the formula

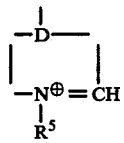

where $R^5$ is an alkyl or aralkyl group and D is the atoms necessary to complete a heterocyclic ring, such as a 5- or 6-membered heterocyclic ring, e.g., a pyridinium or imidazolium ring or, when n is 1, $Q^{\oplus}$ is a group of the formula

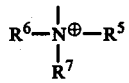

where $R^5$ is defined above and $R^6$ and $R^7$ are independently chosen from the group consisting of alkyl, aryl, alkaryl and aralkyl; and $X^-$ is an anion, i.e., a monovalent negative salt-forming radical or atom in ionic relationship with the positive or cationic monomer, such as a halide, alkyl sulfate, sulfonate, carboxylate, phosphate or similar anion;

wherein in each instance the alkyl moieties, except as otherwise indicated are preferably of from 1 to 5 carbon atoms and the aryl moieties are from 6 to 10 carbon atoms, e.g., phenyl and naphthyl. It is recognized that repeating units having similar properties are obtained when the alkyl and aryl moieties are themselves substituted. It is also recognized that alkenyl groups yield monomers essentially similar to those containing alkyl groups. Phosphonium analogues of the above-identified ammonium monomers are known in the art and can be alternatively employed.

Useful hydrophobic polymers containing cationically ionizable repeating units can be prepared by direct polymerization of monomers such as the following:

CM-1 — N-vinylbenzyl-N,N,N-trimethylammonium chloride
CM-2 — N-benzyl-N,N-dimethyl-N-vinylbenzylammonium chloride
CM-3 — N,N,N-trihexyl-N-vinylbenzylammonium chloride
CM-4 — N-(3-maleimidopropyl)-N,N,N-trimethylammonium chloride
CM-5 — N-benzyl-N-(3-maleimidopropyl)-N,N-dimethylammonium chloride
CM-6 — N-vinyloxycarbonylmethyl-N,N,N-trimethylammonium chloride
CM-7 — N-(3-acrylamido-3,3-dimethylpropyl)-N,N,N-trimethylammonium methosulfate
CM-8 — 1,2-dimethyl-5-vinylpyridinium methosulfate
CM-9 — N-(2-hydroxy-3-methacryloyloxypropyl)-N,N,N-trimethylammonium chloride
CM-10 — N-(2-hydroxy-3-methacryloyloxypropyl)-N,N,N-trimethylammonium sulfate
CM-11 — N-(2-methacryloyloxyethyl)-N,N,N-trimethylammonium iodide
CM-12 — N-(2-methacryloyloxyethyl)-N,N,N-trimethylammonium p-toluenesulfonate
CM-13 — N-(2-methacryloyloxyethyl)-N,N,N-trimethylammonium methosulfate
CM-14 — 3-methyl-1-vinylimidazolium methosulfate
CM-15 — N-(2-methacryloyloxyethyl)-N,N,N-trimethylammonium acetate
CM-16 — N-(2-methacryloyloxyethyl)-N,N,N-trimethylammonium bromide
CM-17 — N-(2-methacryloyloxyethyl)-N,N,N-trimethylammonium chloride
CM-18 — N-(2-methacryloyloxyethyl)-N,N,N-trimethylammonium fluoride
CM-19 — N-(2-methacryloyloxyethyl)-N,N,N-trimethylammonium nitrate
CM-20 — N-(2-methacryloyloxyethyl)-N,N,N-trimethylammonium phosphate According to an alternative preparation approach the hydrophobic polymers can be formed having repeating units of the type indicated above by preparing the hydrophobic polymer in a form which is quaternizable, as by employing monomers in the formation of the polymers containing tertiary amine groups so that quaternization after polymerization is easily effected by reaction with an alkylating agent, for example, benzyl chloride, methyl p-toluenesulfonate, dimethyl sulfate, etc. Illustrative monomers containing quaternizable tertiary amine groups (including tertiary amine groups which form heterocyclic rings) are the following:

CM-21 — 1,3-bis(dimethylamino)isopropyl methacrylate
CM-22 — 4-(N,N-diethylamino)-1-methylbutyl acrylate
CM-23 — 2-(N,N-diethylamino)ethyl acrylate
CM-24 — 2-(N,N-diethylamino)ethyl methacrylate
CM-25 — 3-(N,N-diethylamino)propyl acrylate
CM-26 — N-(1,1-dimethyl-3-dimethylaminopropyl)acrylamide
CM-27 — 3,6-dimethyl-3,6-diazaheptyl acrylate
CM-28 — 2-(N,N-dimethylamino)ethyl acrylate
CM-29 — 2-(N,N-dimethylamino)ethyl methacrylate
CM-30 — N-(2-dimethylaminoethyl)acrylamide
CM-31 — N-(2-dimethylaminoethyl)methacrylamide
CM-32 — 3-(N,N-dimethylamino)propyl acrylamide
CM-33 — 2-(5-ethyl-2-pyridyl)ethyl acrylate
CM-34 — 2-phenyl-1-vinylimidazole
CM-35 — 2-methyl-1-vinylimidazole
CM-36 — 1-vinylimidazole
CM-37 — 2-methyl-5-vinylpyridine
CM-38 — 2-vinylpyridine
CM-39 — 4-vinylpyridine Instead of employing monomers containing tertiary amine groups or quaternized nitrogen atoms as described above to form the hydrophobic polymers, it is also possible to form the polymer so that it contains reactive groups (e.g., halomethyl). The polymer can then be quaternized by treatment with any tertiary amine such as listed on page 281 of Eastman Organic Chemical Catalogue No. 47. When the cationically ionizable repeating units are formed by this technique, vinyl esters of halocarboxylic acids and vinylbenzyl halides can be employed as monomers. The following are exemplary preferred monomers:

CM-40 vinyl chloroacetate
CM-41 vinyl bromoacetate
CM-42 vinyl 2-chloropropionate
CM-43 vinyl 3-chloropropionate
CM-44 vinyl 2-bromobutyrate
CM-45 2-vinylbenzyl chloride
CM-46 4-vinylbenzyl chloride Cationically ionizable repeating units of the type preferred, as well as others, are generally well known in the art. Further illustrative of cationically ionizable repeating units suitable for use in the practice of this invention are those disclosed in Cohen et al U.S. Pat. No. 3,488,706, issued Jan. 6, 1970; Cohen et al. U.S. Pat. No. 3,557,066, issued Jan. 19, 1971; Cohen et al. U.S. Pat. No. 3,625,694, issued Dec. 7, 1971; Cohen et al. U.S. Pat. No. 3,709,690, issued Jan. 9, 1973; Cohen et al. U.S. Pat. No. 3,758,445, issued Sept. 11, 1973; Cohen et al. U.S. Pat. No. 3,788,855, issued Jan. 29, 1974; Campbell U.S. Pat. No. 3,868,252, issued Feb. 25, 1975; Cohen et al. U.S. Pat. No. 3,898,088, issued Aug. 5, 1975; Campbell et al. U.S. Pat. No. 3,958,995, issued May 25, 1976; and King et al. U.S. Pat. No. 3,962,527, issued June 8, 1976.

Up to half or less than 50 percent, on a mole basis, of the ionizable monomers which form repeating units in the hydrophobic polymer can be anionically ionizable.

In a specific preferred form these repeating units are formed from ethenic hydrophilic monomers having a molecular weight of less than 300 of the following formula:

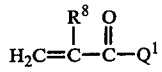

(II)

wherein $R^8$ is hydrogen, chlorine or lower alkyl of from 1 to 5 carbon atoms, preferably hydrogen or methyl, $Q^1$ is —OM or an organic radical which together with the carbonyl group of the formula forms an ester or amide group terminating in a hydroxy, COOM or $SO_3M$ solubilizing group; and M is hydrogen, ammonium or alkali metal. Exemplary monomers of this type are disclosed, for example, in U.S. Pat. Nos. 2,933,734 (issued Feb. 2, 1960); 3,024,221 (issued Mar. 6, 1962); 3,411,911 (issued Nov. 19, 1968) and 3,506,707 (issued Apr. 14, 1970). Specific exemplary hydrophilic ethenic anionically ionizable monomers useful in the practice of this invention include the following:

AM-1 aconitic acid
AM-2 2-acrylamido-2-methylpropanesulfonic acid
AM-3 3-acrylamidopropane-1-sulfonic acid
AM-4 acrylic acid
AM-5 methacrylic acid
AM-6 4-acryloyloxybutane-1-sulfonic acid
AM-7 3-acryloyloxypropionic acid
AM-8 3-acryloyloxybutane-1-sulfonic acid
AM-9 3-acryloyloxypropane-1-sulfonic acid
AM-10 4-t-butyl-9-methyl-8-oxo-7-oxa-4-aza-9-decene-1-sulfonic acid
AM-11 α-chloroacrylic acid
AM-12 maleic acid
AM-13 chloromaleic acid
AM-14 2-methacryloyloxyethyl-1-sulfonic acid
AM-15 citraconic acid
AM-16 — crotonic acid
AM-17 — fumaric acid
AM-18 — mesaconic acid
AM-19 — α-methyleneglutaric acid
AM-20 — monoethyl fumarate
AM-21 — monomethyl α-methyleneglutarate
AM-22 — monomethyl fumarate
AM-23 — vinylsulfonic acid
AM-24 — p-styrenesulfonic acid
AM-25 — 4-vinylbenzylsulfonic acid
AM-26 — acryloyloxymethylsulfonic acid
AM-27 — 4-methacryloyloxybutane-1-sulfonic acid
AM-28 — 2-methacryloyloxyethane-1-sulfonic acid
AM-29 — 3-methacryloyloxypropane-1-sulfonic acid
AM-30 — 2-acrylamidopropane-1-sulfonic acid
AM-31 — 2-methacrylamido-2-methylpropane-1-sulfonic acid
AM-32 — 3-acrylamido-3-methylbutane-1-sulfonic acid (* In place of the acidic hydrogen can be an alkali metal cation, preferably Na or K, or an ammonium ion.)

In the preferred form at least 70 percent by weight of the hydrophobic polymer is formed of repeating units derived from ethenic monomers having a molecular weight of 300 or less which form nonionic homopolymers. These monomers can take a variety of forms. Up to 30 percent by weight of the repeating units making up the hydrophobic polymers can be derived from monomers which form nonionic hydrophilic homopolymers. For example, in an illustrative preferred form monomers which form nonionic hydrophilic homopolymers can be acrylamides of the general formula:

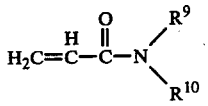

(III)

where
$R^9$ and $R^{10}$ are hydrogen or alkyl or haloalkyl substituents having from 1 to 5 carbon atoms.

Specifically preferred acrylamide monomers according to Formula III include

HLM- 1 — acrylamide
HLM- 2 — N-methylacrylamide
HLM- 3 — N,N-dimethylacrylamide
HLM- 4 — N-iso-propylacrylamide
HLM- 5 — N-butylacrylamide
HLM- 6 — N-pentylacrylamide
HLM- 7 — N-chloromethylacrylamide
HLM- 8 — N-(4-chlorobutyl)acrylamide
HLM- 9 — N-(2,2-dichloroethyl)acrylamide
HLM-10 — N-bromomethylacrylamide.

A major and essential component of the hydrophobic polymers are repeating units capable of forming hydrophobic homopolymers. These repeating units can be derived in a preferred form from one or a mixture in any proportion of the following monomers:

(i) The monomers of this class can be generically designated as ethenic monomers of the formula:

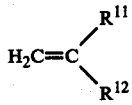

(IV)

where
$R^{11}$ is hydrogen, halogen or vinyl and
$R^{12}$ is hydrogen, halogen or methyl or, when
$R^{11}$ is hydrogen, cyano. Specific preferred monomers satisfying Formula IV above are isoprene, chloroprene, 1,3-butadiene, propenenitrile, and vinylidene chloride. The use of other conventional polymerizable monomers satisfying Formula IV, such as vinyl chloride, vinyl fluoride, vinylidene fluoride, ethylene, propylene and the like, is specifically contemplated.

(ii) The monomers of this class can be generically designated as styrene-type monomers of the formula:

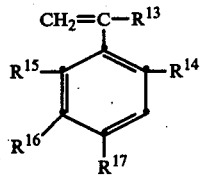

(V)

where
$R^{13}$ is hydrogen or methyl,
$R^{14}$, $R^{15}$ and $R^{17}$ are hydrogen or lower alkyl of from 1 to 5 carbon atoms,
$R^{16}$ is hydrogen and with $R^{15}$ constitutes the atoms necessary to complete a fused benzene ring or
one of $R^{16}$ and $R^{17}$ is halomethyl. Exemplary of monomers satisfying Formula V are styrene, o-vinyltoluene, p-vinyltoluene, p-chloromethylstyrene, m-chloromethylstyrene, α-methylstyrene, 2-ethylstyrene, 4-butylstyrene, 4-pentylstyrene, 2-vinylmesitylene and 1-vinylnaphthalene.

(iii) The monomers of this class can be generally designated as esters of 2-alkenoic acids having the formula

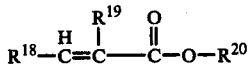

(VI)

where
$R^{18}$ is hydrogen or lower alkyl of from 1 to 5 carbon atoms, $R^{19}$ is hydrogen, chlorine or lower alkyl of from 1 to 5 carbon atoms and $R^{20}$ is alkyl or haloalkyl having from 1 to 20 carbon atoms.

In a preferred form $R^{18}$ is hydrogen and $R^{19}$ is hydrogen or methyl, so that the esters are formed from acrylic or methacrylic acid. In this preferred form $R^{20}$ contains from one to five carbon atoms. The preferred esters of 2-alkenoic acids are then lower alkyl esters of acrylic and methacrylic acid, such as methyl, ethyl, propyl, iso-propyl, butyl, isobutyl, tert-butyl, pentyl, neo-pentyl and similar esters of acrylic and methacrylic acid. The use of other esters of 2-alkenoic acids as defined by Formula VI is specifically contemplated. In addition to esters of acrylic and methacrylic acid, esters of acids such as α-ethylacrylic acid, α-propylacrylic acid, α-butylacrylic acid, α-pentylacrylic acid, 2-butenoic acid, 2-methyl-2-butenoic acid, 2-hexenoic acid, 2-octenoic acid, 2-methyl-2-octenoic acid and similar acids are specifically contemplated. In addition to the lower alkyl esters, hexyl, heptyl, octyl, undecyl, dodecyl, tetradecyl, hexadecyl, octadecyl, eicosyl and isomeric branched chain esters of the above-noted 2-alkenoic acids are specifically contemplated.

(iv) The repeating units of this class can be formed in whole or in part by vinyl acetate.

In addition or alternatively the repeating units capable of forming hydrophobic homopolymers can be derived from one or more of the following monomers in the proportions indicated:

(v) The repeating units of this class form from 0 to 60 percent by weight of the preferred class of polymers. The repeating units of this class are derived from hardenable (i.e. crosslinkable after polymerization) ethenic monomers having a molecular weight of at most about 300. In a preferred form the repeating units of this class can be formed by one or more hardenable ethenic monomers which contain one or more groups which can be crosslinked after polymerization by reaction with a photographic hardener, such as an aldehydic hardener (e.g. formaldehyde or succinaldehyde), a mucohalic acid hardener, a triazine chloride hardener, a vinyl sulfone hardener (e.g. bis(vinylsulfonylmethyl) ether, bis(vinylsulfonyl)methane, etc.), an aziridine hardener and the like.

The repeating units of this class perform the function of rendering the preferred class of polymers hardenable after polymerization has occurred, typically after loading of the polymer particles. In photographic applications it is advantageous to harden hydrophilic colloid vehicles after adding photographic addenda and coating. By incorporating hardenable repeating units in the preferred class of polymers they can be hardened concurrently with hydrophilic colloid in which they are present using conventional photographic hardeners and hardening procedures. Hardening of the loaded polymer particles can also be undertaken before coating independently of any hydrophilic colloid. Hardening of the polymer particles can offer advantages similar to those achieved in hardening photographic vehicles and, in addition, can serve to regulate the release of loaded hydrophobes and improve the abrasion resistance of the polymer particles. Hardening after loading of the polymer particles is, of course, advantageous in that the rate at which the hydrophobe is introduced is not limited, as occurs if the polymer particles are formed of initially crosslinked polymers. Thus, the rates of loading and release of hydrophobe can be independently adjusted through hardening.

We prefer that at least 0.2 percent by weight of the preferred class of polymers be formed of hardenable repeating units. We generally prefer that from 0.2 to 10 percent by weight of the preferred class of polymers be formed of the hardenable repeating units of this class.

A specific preferred class of monomers capable of forming hardenable repeating units are those monomers which contain both vinyl unsaturation and active methylene groups. The active methylene groups serve as hardening sites. In one specific form the active methylene group takes the form of a methylene group linking two carbonyl groups or a carbonyl and a cyano group. A specific preferred monomer of this type can be generically designated by the following formula:

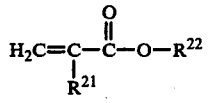

where $R^{21}$ is hydrogen, alkyl having from 1 to 12 carbon atoms or

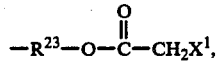

$R^{22}$ is alkyl having from 1 to 10 carbon atoms, cycloalkyl having from 3 to 10 carbon atoms, phenyl or

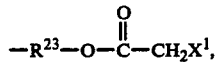

$R^{23}$ is alkylene having from 1 to 10 carbon atoms and $X^1$ is cyano or alkylcarbonyl having from 1 to 8 carbon atoms, provided that one and only one of $R^{21}$ and $R^{22}$ is always

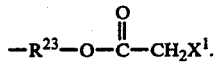

Specific exemplary monomers of this type are disclosed in U.S. Pat. Nos. 3,459,790 (issued Aug. 5, 1969); 3,488,708 (issued Jan. 6, 1970) and 3,554,987 (issued Jan. 12, 1971). Examples of such preferred hardenable ethenic monomers include:

HDM- 1 — N-allylcyanoacetamide,
HDM- 2 — ethyl methacryloylacetoacetate,
HDM- 3 — N-cyanoacetyl-N'-methacryloylhydrazine,
HDM- 4 — 2-acetoacetoxyethyl methacrylate,
HDM- 5 — N-(3-methylacryloyloxypropyl)-cyanoacetamide,
HDM- 6 — 2-cyanoacetoxyethyl methacrylate,
HDM- 7 — N-(2-methacryloyloxyethyl)cyanoacetamide,
HDM- 8 — ethyl alpha-acetoacetoxymethylacrylate,
HDM- 9 — 2-acetoacetoxypropyl methacrylate,
HDM-10 — 3-acetoacetoxy-2,2-dimethylpropyl methacrylate,
HDM-11 — N-(methacryloyloxymethyl)acetoacetamide, HDM-12 — N-t-butyl-N-(methacryloyloxyethyl-)acetoacetamide,
HDM-13 — 2-acetoacetoxyethyl acrylate and
HDM-14 — 2-acetoacetoxy-2-methylpropyl methacrylate.

(vi) The repeating units of this class form from 0 to 5 percent by weight of the preferred class of polymers. These repeating units are derived from crosslinking monomers. Specifically, these repeating units are typically formed by monomers containing at least two independently polymerizable, usually nonconjugated, vinyl groups. These repeating units can be incorporated into the preferred class of polymers for increasing their hydrophobicity; reducing their tendency to swell, in aqueous solutions, at elevated temperatures or when brought into contact with the water-miscible organic solvents; reducing any tendency of the polymer particles to agglomerate or coagulate; improving the abrasion resistance of polymer particles and/or regulating the loading of the polymer particles. It is generally preferred that from 0.2 to 3 percent by weight of the preferred class of polymers be derived from the crosslinking monomers. It is recognized that the crosslinking monomers of this class of repeating units can be employed independently of the repeating units (v). Taking into account the similarities in the repeating units (v) and (vi), it is apparent that the crosslinking achieved by these units can be achieved by one or a combination of these repeating units used as alternatives or in combination. The repeating units of this class differ from those of class (v) above in that they cause crosslinking to occur concurrently with polymerization.

Suitable examples of monomers from which the repeating units (vi) are formed are divinylbenzene, allyl acrylate, allyl methacrylate, N-allylmethacrylamide, 4,4'-isopropylidenediphenylene diacrylate, 1,3-butylene diacrylate, 1,3-butylene dimethacrylate, 1,4-cyclohexylenedimethylene dimethacrylate, ethylene glycol dimethacrylate, diisopropylene glycol dimethacrylate, divinyloxymethane, ethylene diacrylate, ethylidene diacrylate, propylidene dimethacrylate, 1,6-diacrylamidohexane, 1,6-hexamethylene diacrylate, 1,6-hexamethylene dimethacrylate, N,N'-methylenebisacrylamide, neopentyl glycol dimethacrylate, phenylethylene dimethylacrylate, tetraethylene glycol dimethacrylate, tetramethylene diacrylate, tetramethylene dimethacrylate, 2,2,2-trichloroethylidene dimethacrylate, triethylene glycol diacrylate, triethylene glycol dimethacrylate, ethylidyne trimethacrylate, propylidyne triacrylate, vinyl allyloxyacetate, vinyl methacrylate, 1-vinyloxy-2-allyloxyethane, and the like. Divinylbenzene and ethylene glycol dimethacrylate are particularly preferred monomers.

The hydrophobic polymers employed in this invention are in the form of particles derived from aqueous latexes. The aqueous latexes are distinctive in that the loadable polymer particles are highly dispersed as compared to coupler solvent and similar hydrophobic particle dispersions in hydrophilic colloid coatings. The loadable polymer particles exhibit an average diameter in the range of from 0.02 to 0.2 micron, preferably in the range of from about 0.02 to 0.08 micron. (Although some swelling can occur during loading, the loaded polymeric latex particles also typically and preferably fall within these same ranges of average diameters.) The loadable polymer particles form at least 2 percent by weight of the aqueous latex and preferably form at least 10 percent by weight thereof. Preferably the aqueous latex contains about 20 percent by weight or less of the loadable polymer particles.

Procedures for producing aqueous latexes useful as starting materials in the practice of our process will be readily apparent to those skilled in the art and do not form a part of our invention. The aqueous latexes can be formed, for example, using conventional free radical polymerization techniques for forming organic polymer hydrosols. Typically the aqueous latex with the polymer particles distributed therein can be conveniently formed by charging into water various monomers necessary to form the desired loadable polymer together with minor amounts of ingredients such as polymerization initiators, surfactants to disperse the monomers, etc. The proportions in which the monomers are employed will determine approximately the proportions of the repeating units in the resulting loadable polymers. More exact control of the proportions of repeating units in the resulting loadable polymers can be achieved by taking into account the known differences in the polymerization rates of the monomers. The proportions of the repeating units in the preferred class of loadable polymers discussed above can be taken alternately as the proportions of the monomers to be introduced for polymerization, since the differences in proportions introduced by this variance are not significant for the purposes of this process. Upon polymerization, an aqueous latex with the desired loadable polymer particles dispersed in an aqueous continuous phase is produced. The latex composition produced can be used directly as the aqueous latex employed in the loading process or, optionally, any minor amounts of materials other than water and loadable polymer particles which may be present can be at least partially separated from the aqueous latex by conventional techniques. Exemplary of useful free radical polymerization techniques which can be employed in forming the aqueous latexes are those described in U.S. Pat. Nos. 2,914,499; 3,033,833; 3,547,899 and Canadian Pat. No. 704,778. A preferred method for manufacturing the aqueous latexes useful in the practice of this invention is described also in the Chen disclosures, cited above.

Illustrative of aqueous latexes containing loadable polymer particles useful in the practice of our process are those set forth below. The proportions of the monomers reacted to form the loadable polymers are given in terms of the relative proportions of the monomers when introduced into the polymerization vessel. The proportion of the continuous phase, consisting essentially of water, not separately listed, can be anywhere within the preferred range of from 80 to 90 percent by weight, since even broader variations in the proportion of the continuous phase have little observable effect on the utility of the aqueous latexes in practicing the loading process.

L-1 Poly(butyl methacrylate-co-2-methacryloyloxyethyltrimethylammonium methosulfate-co-2-acrylamido-2-methylpropanesulfonic acid) (Weight ratio 80:15:5)
L-2 Poly(butyl acrylate-co-2-methacryloyloxyethyltrimethylammonium methosulfate-co-2-acrylamido-2-methylpropanesulfonic acid) (Weight ratio 80:15:5)
L-3 Poly(ethyl acrylate-co-2-methacryloyloxyethytrimethylammonium methosulfate-co-2-acrylamido-2-methylpropanesulfonic acid) (Weight ratio 80:15:5)

-continued

| | |
|---|---|
| L-4 | Poly(butyl acrylate-co-styrene-co-2-methacryloyloxyethyltrimethylammonium methosulfate-co-2-acrylamido-2-methylpropanesulfonic acid) Weight ratio 40:40:15:5) |
| L-5 | Poly(butyl methacrylate-co-styrene-co-2-methacryloyloxyethyltrimethylammonium methosulfate-co-2-acrylamido-2-methylpropanesulfonic acid) (Weight ratio 40:40:15:5) |
| L-6 | Poly(ethyl acrylate-co-styrene-co-2-methacryloyloxyethyltrimethylammonium methosulfate-co-2-acrylamido-2-methylpropanesulfonic acid) (Weight ratio 40:40:15:5) |
| L-7 | Poly(styrene-co-2-methacryloyloxyethyltrimethylammonium methosulfate-co-2-acrylamido-2-methypropanesulfonic acid) (Weight ratio 80:15:5) |
| L-8 | Poly(styrene-co-2-methacryloyloxyethyltrimethylammonium methosulfate) (Weight ratio 90:10) |
| L-9 | Poly(butyl methacrylate-co-2-methacryloyloxyethyltrimethylammonium methosulfate) (Weight ratio 90:10) |
| L-10 | Poly(butyl methacrylate-co-styrene-co-2-methacryloyloxyethyltrimethylammonium methosulfate) (Weight ratio 40:55:5) |
| L-11 | Poly(butyl methacrylate-co-2-methacryloyloxyethyltrimethylammonium methosulfate) (Weight ratio 95:5) |
| L-12 | Poly(butyl methacrylate-co-styrene-co-2-methacryloyloxyethyltrimethylammonium methosulfate-co-2-acrylamido-2-methylpropanesulfonic acid) (Weight ratio 47:40:10:3) |
| L-13 | Poly(butyl acrylate-co-styrene-co-2-methacryloyloxyethyltrimethylammonium methosulfate) (Weight ratio 40:50:10) |
| L-14 | Poly(butyl acrylate-co-2-methacryloyloxyethyltrimethylammonium methosulfate) (Weight ratio 95:5) |
| L-15 | Poly(butyl acrylate-co-styrene-co-2-methacryloyloxyethyltrimethylammonium methosulfate) (Weight ratio 31:68:1) |
| L-16 | Poly(butyl acrylate-co-vinylidene chloride-co-2-methacryloyloxyethyltrimethylammonium methosulfate) (Weight ratio 50:45:5) |
| L-17 | Poly(vinylidene chloride-co-styrene-co-2-methacryloyloxyethyltrimethylammonium methosulfate) (Weight ratio 50:45:5) |
| L-18 | Poly(methyl methacrylate-co-2-methacryloyloxyethyltrimethylammonium methosulfate-co-3-acrylamido-2-methylpropane sulfonic acid) (Weight ratio 80:15:5) |
| L-19 | Poly(butyl acrylate-co-styrene-co-2-methacryloyloxyethyltrimethylammonium methosulfate Weight ratio 30:55:15) |
| L-20 | Poly(butyl acrylate-co-2-methacryloyloxyethyltrimethylammonium methosfulate-co-2-acrylamido-2-propanesulfonic acid) (Weight ratio 85:10:5) |

Hydrophobes

To be considered a hydrophobic compound (or, more succinctly, a hydrophobe) as that term is employed herein the compound must be essentially insoluble in distilled water at 25° C. Preferably the dissolved concentration of hydrophobe in water under these conditions should be less than 0.5 percent by weight, based on the weight of the water. Any such hydrophobe can be employed in the practice of our process which can be dissolved in a liquid consisting of one or a mixture of water-miscible organic solvents. Preferably the hydrophobe must be soluble in a concentration of at least 5 percent by weight, based on the total weight of the water-miscible organic solvent and dissolved hydrophobe. In practice minor amounts of essentially diluent materials, such as minor amounts of water commonly entrained in water-miscible solvents, can be associated with the blended hydrophobe and water-miscible organic solvent. It is preferred that the hydrophobe and water-miscible organic solvent or solvents are chosen so that additional materials, such as pH or other modifiers—e.g. acid or alkali—are not required to dissolve the hydrophobe.

Developing agents are well known to chemists ordinarily skilled in photographic processing chemistry. Those which are hydrophobic and which are soluble in one or more water-miscible solvents in accordance with the requirements set out above are useful in the practice of this invention. Many useful hydrophobic developing agents are described in some of the publications referred to in *Product Licensing Index*, Vol. 92, p. 110 (1971). Some typical, non-limiting examples of such useful hydrophobic materials include substituted ascorbic acids such as isopropylidene ascorbic acid and aminophenyl ascorbic acid, and the like; hydrophobic p-aminophenols such as p-benzylaminophenol, p-alpha-aminoethylaminophenol and N-morpholino-p-aminophenol; other useful substituted phenols such as those hydrophobic materials described in U.S. Pat. No. 3,801,321 (e.g., methylene-2,2'-bis(4-methyl-6-t-butylphenol), 4-benzenesulfonamidophenol, as well as the phosphoramidophenol, phosphoramidoaniline; pyrazolidone developing agents, such as 1-phenyl-3-pyrazolidone, 4,4-dimethyl-1-phenyl-3-pyrazolidone and 4-methyl-1-phenyl-3-pyrazolidone and other N-heterocyclic developing agents such as 1-(p-aminophenyl)-3-aminopyrazoline, 4-amino-2-pyrazolin-5-one-3-carboxylic acid, the 2H-azepin-2-ones, and reductone type agents such as those described in U.S. Pat. Nos. 3,672,896 and 3,679,426, including dihydroanhydropiperidino hexose reductone and 2,3-dihydroxy-4,4,5,5-tetramethyl-2-cyclopentene-1-one, and developing materials like 3-benzoyl-6-hydroxycoumarin and 4-hydroxy undecanohydrazide. Useful hydrophobic developing agents also include those hydrophobic bis-beta-naphthols described in U.S. Pat. No. 3,672,904 and U.S. Pat. No. 3,751,249. Also exemplary as useful materials are all of the hydrophobic p-phenylenediamines. Schiff bases of developing agents which are useful in the practice of this invention are those products from the reaction of an aldehyde with an amino developing agent such as a p-aminophenol or a p-phenylenediamine which meet the requirements for hydrophobicity and solubility in water-miscible solvent(s) set out above. Some additional specific examples of useful hydrophobic developing agents are set out below:

| | Name | Structure |
|---|---|---|
| H-1 | Dihydroanhydro-piperidino hexose reductone | 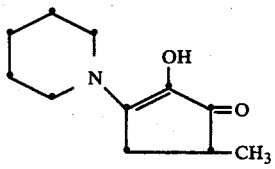 |

-continued

| Name | Structure |
|---|---|
| H-2 Isopropylidene ascorbic acid | 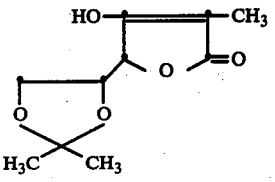 |
| H-3 1-Phenyl-3-pyrazolidinone | 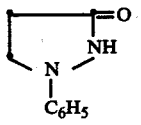 |
| H-4 4-Methyl-1-phenyl-3-pyrazolidone | 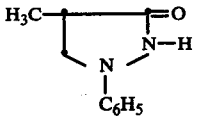 |
| H-5 4-Hydroxy-2-oxo-1-phenyl-3-(4-methyl-piperidino)-3-pyrroline | 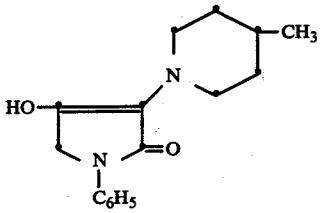 |
| H-6 4-Hydroxy-2-oxo-1-phenyl-3-(N,N-diethylamino)-3-pyrroline | 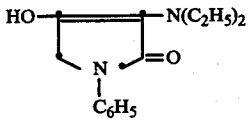 |
| H-7 1-Benzyl-4-hydroxy-3-piperidino-1,5,6,7-tetrahydro-2H-azepin-2-one | 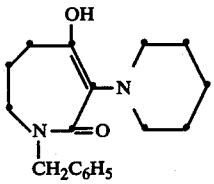 |
| H-8 1-Benzyl-4-hydroxy-3-(4'-methylpiperidino)-1,5,6,7-tetrahydro-2H-azepin-2-one | 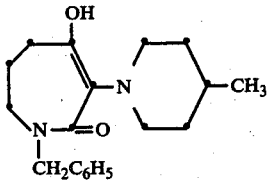 |
| H-9 1,6-Dihydro-4,5-dihydroxy-1-methyl-2-propyl-6-pyrimidone | 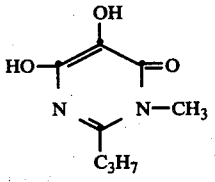 |
| H-10 2-Isopropyl-4,5,6-trihydroxypyrimidine | 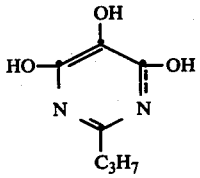 |
| H-11 p-Benzylaminophenol | 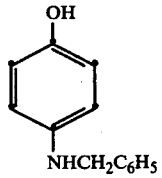 |
| H-12 N-morpholino-p-aminophenol | 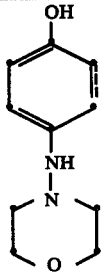 |
| H-13 4-Hydroxy-3-morpholino-2-oxo-1-phenyl-3-pyrroline | 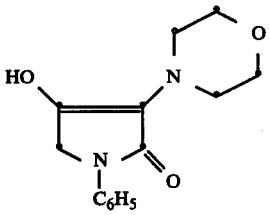 |
| H-14 1-Cyclohexyl-4-hydroxy-2-oxo-3-piperidyl-3-pyrroline | 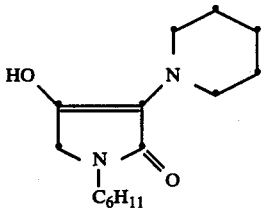 |
| H-15 1-Cyclohexyl-3-diethylamino-4-hydroxy-2-oxo-3-pyrrolidine | 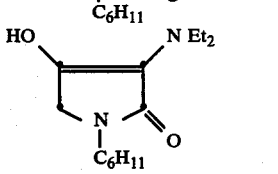 |
| H-16 1-Cyclohexyl-4-hydroxy-5-methyl-2-oxo-3-(4-methyl-piperidino)-3-pyrroline | 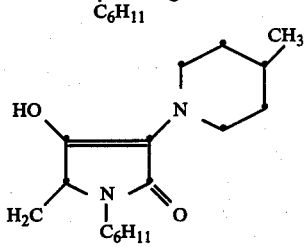 |
| H-17 4-Hydroxy-3-(4'-methylpiperidino)-2-oxo-1 azabicyclo [0.3.3] Oct-3-ene | 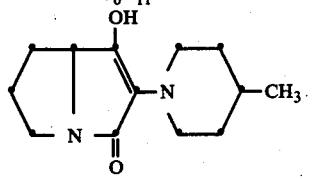 |

While the present invention is concerned with incorporating one or more hydrophobic developing agents into photographic elements by loading developing agent as a hydrophobe into the polymer particles of a loadable latex, it is appreciated that other hydrophobes can also be loaded into the same or different loadable latex particles. For example, Chen in the disclosures cited above discloses the loading of hydrophobes of all conventional types which have heretofore been introduced into hydrophilic colloid layers of photographic elements using coupler solvents. Such hydrophobes include hydrophobic photographic dyes, couplers, ultraviolet absorbers, oxidized developing agent scavengers, etc. In the preferred photographic elements the amount of hydrophobe which can be present in intimate association with the polymer particles of the latex can be anywhere within the range of from 1:4 to 3:1 in terms of a weight ratio of hydrophobe to loadable polymer. Optimally the weight ratio of hydrophobe to loadable polymer in the latex is from about 1:3 to 1:1.

Distributing Vehicles

In various applications of this invention vehicles are employed to distribute the loaded polymeric latexes and to provide a medium in which additional loading can be undertaken. The loaded latexes of this invention are generally useful in combination with conventional hydrophilic colloid photographic vehicles.

As is generally recognized by those skilled in the photographic arts, silver halide emulsion layers and other layers on photographic elements can contain various colloids alone or in combination as vehicles. Suitable hydrophilic vehicle materials include both naturally-occurring substances such as proteins, for example, gelatin, gelatin derivatives, cellulose derivatives, polysaccharides such as dextran, gum arabic and the like; and synthetic polymeric substances such as water soluble polyvinyl compounds like poly(vinylpyrrolidone), acrylamide polymers and the like.

Photographic emulsion layers and other layers of photographic elements such as overcoat layers, interlayers and subbing layers, as well as receiving layers in image transfer elements can also contain in combination with hydrophilic, water-permeable colloids, other synthetic polymeric vehicle compounds such as dispersed vinyl compounds such as in latex form and particularly those which increase the dimensional stability of the photographic materials. Typical synthetic polymers include those described in Nottorf U.S. Pat. No. 3,142,568 issued July 28, 1964; White U.S. Pat. No. 3,193,386 issued July 6, 1965; Houck et al. U.S. Pat. No. 3,062,674 issued Nov. 6, 1962; Houck et al. U.S. Pat. No. 3,220,844 issued Nov. 30, 1965; Ream et al. U.S. Pat. No. 3,287,789 issued Nov. 22, 1966; and Dykstra U.S. Pat. No. 3,411,911 issued Nov. 19, 1968. Other vehicle materials include those water-soluble polymers of alkyl acrylates and methacrylates, acrylic acid, sulfoalkyl acrylates or methacrylates, those which have cross-linking sites which facilitate hardening or curing as described in Smith U.S. Pat. No. 3,488,708 issued Jan. 6, 1970, and those having recurring sulfobetaine units as described in Dykstra Canadian Pat. No. 744,054. Especially effective polymeric binders are those which can withstand processing temperatures above about 250° C.

Loading Procedures

In practicing the technique of Chen for loading the hydrophobe into the latex polymer particles, the starting materials are (1) an aqueous latex consisting essentially of water as a continuous phase and loadable polymer particles as a dispersed phase, and (2) a water-miscible organic solvent having the hydrophobe dissolved therein. As previously indicated, the aqueous latex contains at least 2 percent by weight, based on total weight, of loadable polymer particles, preferably from about 10 to 20 percent by weight loadable polymer particles, based on total weight. The hydrophobe is dissolved in the water-miscible organic solvent in a concentration in the range of from 0.1 to 20 percent by weight, based on total weight, preferably 2 to 20 percent by weight, based on total weight.

The first step of loading is to blend the above starting materials so that a resulting composition in which the hydrophobe remains in solution and the polymer particles remain dispersed as in the starting aqueous latex. The object is to achieve blending with the hydrophobe remaining dissolved and the latex polymer particles remaining dispersed. This will allow an intimate association of the polymer particles to be loaded with the hydrophobe. Any blending technique which will achieve this desired result can be employed. There are many different parameters which will contribute to successful blending without coagulation of the hydrophobe or polymer particles. For example, increasing the rate of stirring during blending generally decreases the tendency of either the hydrophobe or polymer particles to coagulate. Increasing the temperature of the starting materials also tends to reduce any tendency toward coagulation. Increasing the proportion of water tends to increase any tendency of the hydrophobe to coagulate, but reduces any tendency of the polymer particles to coagulate. On the other hand, using a higher proportion of water-miscible organic solvent can have the effect of increasing any tendency of the polymer particles to coagulate while reducing any tendency of the hydrophobe to coagulate. It is generally desirable to avoid even incipient coagulation, since once coagulation of either the hydrophobe or polymer particles begins substantially all of the coagulating material will separate out as a precipitate. Techniques for avoiding precipitation when blending materials are, of course, generally well understood by those skilled in the chemical arts.

A preferred technique for blending is to stir rapidly or otherwise produce turbulence in the water-miscible organic solvent containing dissolved hydrophobe. The aqueous latex containing the dispersed polymer particles is then added to the water-miscible organic solvent at a limited rate. The rate of addition of the aqueous latex is controlled so that the volume of aqueous latex added per second to the water-miscible organic solvent containing dissolved hydrophobe is less than 20% of the initial volume of the water-miscible organic solvent with dissolved hydrophobe, preferably less than 10%. Reversing the order of addition so that the water-miscible organic solvent containing hydrophobe is gradually added to the aqueous latex results in coagulation. If the reverse order of addition is contemplated, avoiding coagulation requires a high rate of blending so that the hydrophobe at all times is in a liquid phase which contains a solubility increasing amount of water-miscible organic solvent. Substantially instantaneous blending of the aqueous latex and water-miscible organic solvent with dissolved hydrophobe while maintaining both in a highly turbulent state would be an ideal approach to achieving reverse order blending without coagulation.

During blending the dispersed polymer particles of the aqueous latex and the dissolved hydrophobe are brought into intimate contact. The loadable polymer particles act as a competing solvent for the hydrophobe so that a portion of the hydrophobe is loaded into the polymer particles. As the proportion of water is increased in the liquid phase of the composition the equilibrium distribution of the hydrophobe between the polymer particles and the liquid phase is driven or shifted toward the polymer particles. In other words, as the hydrophilic character of the liquid phase increases, the solubility of the hydrophobe therein is reduced and the solubility of the hydrophobe in the polymer particles is, by comparison, increased.

Generally the proportion of aqueous latex added to the water-miscible organic solvent containing hydrophobe is maintained in the volume ratio of 1:4 to 4:1, preferably 1:2 to 2:1. Not all of the water added, however, need be present in the aqueous latex. It is contemplated that a portion of the water which might be blended in the aqueous latex can be added subsequent to blending the aqueous latex and water-miscible organic solvent. This reduces the amount of water being introduced initially while achieving finally the same proportion of water in the resulting composition and the same equilibrium distribution of hydrophobe between the polymer particles and liquid phase. It is also recognized that a portion of the water-miscible organic solvent can be initially present in the aqueous latex to be blended, and that this would have the effect of initially reducing any tendency of the hydrophobe to coagulate. Before blending is undertaken no more than 20% by weight, preferably less than 10% by weight of water or water-miscible organic solvent should be present in the hydrophobe containing water-miscible organic solvent or aqueous latex, respectively.

Dilution of the liquid phase with water beyond the proportions indicated to drive further the equilibrium distribution of the hydrophobe toward the polymer particles would appear attractive in terms of loading, but it is preferred to maintain the proportion of water within the indicated limits since the ultimate use for the loaded polymeric latex composition in photographic coating applications requires removal of water.

Upon completion of the blending step a loaded polymeric latex composition is produced in which a substantial fraction of the hydrophobe is dissolved or minutely distributed within the polymer particles.

We prefer to increase further the loading of the polymer particles by removing from the loaded polymeric latex composition at least a major portion—i.e. at least about 50 percent—of the water-miscible organic solvent. Total or partial removal of the water-miscible organic solvent can be undertaken by any convenient conventional technique. One convenient technique is to evaporate the water-miscible organic solvent at ambient conditions or at elevated temperatures and/or reduced pressures. The removal of the water-miscible organic solvent further increases the hydrophilic or aqueous character of the liquid medium and further drives the equilibrium distribution of the hydrophobe toward the polymer particles and away from the liquid phase. In this way, additional loading of the polymer particles is achieved. According to a preferred technique the water-miscible organic solvent is selectively removed by distillation with only a small amount of water being removed, usually only near the end of distillation.

Alternative arrangements for removing water-miscible organic solvents can be undertaken and may be particularly attractive where the water-miscible solvent can not be readily separated by evaporation. For example, one separation approach which can be relied upon to remove water-miscible organic solvents and other liquid phase impurities which may be present is ultrafiltration. Ultrafiltration membranes and equipment which can be employed are disclosed in U.S. Pat. Nos. 3,762,135; 3,789,993; 3,824,299; 3,894,166; 3,645,938; 3,592,672; and 3,527,853, among others. Ultrafiltration procedures are discussed by M. C. Porter in *Ultrafiltration of Colloidal Suspensions,* AIChE Symposium Series No. 120, Vol. 68, 21–30 (1972); G. J. Fallick in *Industrial Ultrafiltration,* pp. 29–34, Process Biochemistry, September 1969; R. L. Goldsmith in *Macromolecular Ultrafiltration with Microporous Membranes,* pp 113–120, Ind. Eng. Chem. Fundam, Vol. 10, No. 1, 1971; M. C. Porter and A. S. Michaels in two articles, both titled *Membrane Ultrafiltration,* pp. 56–64, January, 1971 and pp. 440–445, July, 1971, Chem. Tech. Water will be removed along with the water-miscible organic solvent and other lower molecular weight impurities present. The proportion of water to water-miscible organic solvent will vary, depending upon such parameters as the relative molecular weight and proportion of the water-miscible organic solvent. Water can, of course, be added during or after ultrafiltration to avoid excessive concentration of the latex particles.

In preparing photographic coating compositions we contemplate blending the loaded polymer particles and hydrophilic colloid in a weight ratio of from 1:20 to 20:1, preferably from about 1:5 to 5:1. According to a preferred technique the hydrophilic colloid is dispersed in the loaded polymeric latex composition formed by the initial blending step. It is recognized, however, that the hydrophilic colloid or at least a portion of it can be present in the aqueous latex or other concurrently introduced during the initial blending step. The presence of the hyrophilic colloid will reduce only slightly the amount of hydrophobe loaded during initial blending, but offers a very positive peptizing action on the polymer particles which resists coagulation of these particles.

Once a peptizing amount of hydrophilic colloid has been associated with the loaded polymeric particles of the latex it is possible to remove water-miscible organic solvents and other water soluble impurities present using coagulation washing techniques, such as those conventionally employed in washing silver halide emulsions. By having a peptizer present it is possible to coagulate the solids contained within the loaded polymeric latex composition and to redisperse thereafter the loaded polymer particles in the form of a latex. Techniques for coagulation washing which can be employed are disclosed in U.S. Pat. Nos. 2,618,556; 2,614,928; 2,565,418; 3,241,969 and 2,489,341.

According to one specifically preferred technique of removing water-miscible organic solvents and other water soluble impurities by coagulation washing, a peptizer, such as phthalated gelatin is employed. Precipitation of the gelatin from solution bringing with it the peptized loaded polymer particles is brought about by lowering the pH of the liquid phase of the loaded latex. The supernatant liquid is next separated from the coagulated solids, as by decanting, washed with water and the latex reconstituted by adjusting the pH upwardly using a deprotonating agent, such as a base or sodium citrate. This procedure for separating water-miscible organic solvent is preferably employed where only a peptizing amount of hydrophilic colloid, such as gelatin is present, and before the larger amounts of hydrophilic colloid are added necessary to form a coating composition. This procedure for removing water-miscible organic solvent can, of course, be employed at any stage between loading and peptizing of the polymer particles and coating of the loaded polymeric latex composition.

The process for manufacturing loaded latex compositions and for incorporating the resulting composition into a layer which contains at least one hydrophilic colloid, can be practiced at temperatures ranging from about 0° C. to about 40° C. or more. Where a hydrophilic colloid is being employed having a highly temperature dependent viscosity, such as gelatin, elevating and lowering temperature is recognized in the art to be a useful tool in solubilizing, coating and setting the hydrophilic colloid. It is generally preferred to carry out the hydrophobic loading steps of the present process at about 25° C. or higher. It has been observed that in certain circumstances, usually when loadable polymeric latexes which contain relatively harder polymeric particles (i.e., those loadable latexes having relatively higher Tg's), the latex particles can be made more receptive to the hydrophobic material if relatively higher temperature, such as about 30° C. or higher are used during the imbibition step of the present process.

The water-miscible organic solvents useful in the practice of this invention are those which:

(a) can be dissolved in (i.e., are "miscible" with) distilled water at 20° C. to the extent of at least about 20 parts by volume of solvent in 80 part by volume of water;

(b) have boiling points (at atmospheric pressure) above about −10° C.;

(c) do not detrimentally react chemically with aqueous latexes containing the loadable polymer particles which are useful in the practice of this invention; and (d) do not dissolve more than about 5 weight percent of such loadable polymer particles at 20° C.

Regarding requirement "c" for solvents useful in the practice of this invention, reaction between the solvent and polymer may be possible under certain circumstances, but is believed to be unlikely. Typical non-limiting examples of such useful water-miscible organic solvents are water-miscible alcohols, ketones and amides, (e.g. acetone, ethanol, methanol, isopropyl alcohol, dimethylformamide, methyl ethyl ketone), tetrahydrofuran, N-methyl-2-pyrrolidone, dimethyl sulfoxide, dioxane and mixtures thereof. Of these, acetone, methanol, dioxane and/or tetrahydrofuran are preferred when the hydrophobic material in question is soluble therein.

The loading procedure described above is more fully described by the Chen disclosures, cited above. An alternative loading technique which can be relied upon to at least supplement the Chen loading procedure is that disclosed in Millikan U.S. Pat. No. 3,418,127, issued Dec. 24, 1968. According to this technique the hydrophobe to be loaded, the monomers from which the polymer is to be formed and a polymerization initiator are blended together. Upon polymerization the hydrophobe is loaded into the latex polymer particles similarly as in the Chen process. However, this technique of loading is in many instances limited in the amount of hydrophobe which can be incorporated in the polymer particles. It is possible to load the latex polymer particles partially with the polymerization loading techniques of Millikan and then to increase loading to the desired concentration levels by the process of Chen.

Activator Precursors

The activator precursors employed in the practice of this invention are compounds employed for the purpose of releasing base during thermal processing of a photographic element to facilitate development. The activator precursors are compounds of a protonated basic nitrogen containing moiety and an acid anion. The activator precursors are present in the hydrophilic colloid layers in a concentration of at least one equivalent for each mole of radiation-sensitive silver halide in the same or an adjacent colloid layer up to about 4 equivalents per mole of silver halide. In a preferred form the activator precursor is present in a concentration of from 1.2 to 2.0 equivalents per mole of silver halide. In the preferred form the activator precursor is also a stabilizer precursor—that is, an activator-stabilizer precursor. As a stabilizer its function is to stabilize the silver image that is produced by thermal processing. In the absence of the stabilizing functions photographic images are obtained, but can be obscured within a period of time by background printup.

The preferred activator precursor compounds employed in the practice of this invention are activator-stabilizer precursors which can be represented by the formula:

$$Q_mA_w$$

Wherein Q is a base portion, especially a protonated basic nitrogen containing moiety, and A is a acid anion, such as a carboxylate anion; and wherein m and w are integers, depending on the nature of the cation and anion, sufficient to form a neutral compound. A neutral compound as described herein is intended to mean a compound that has a net charge of zero. That is, the compound is neutralized because the number of acid groups is balanced by the number of basic groups with none in excess. The term "protonated" herein is intended to mean that one or more hydrogen ions ($H^+$) are bound to an amine moiety forming a positively charged species. Typically m is 1 to 4 and w is 1 to 2. For example, when Q is a bivalent cation and A is a univalent anion, m is 1 and w is 2.

A can be a carboxylate anion which is decarboxylatable at temperatures above about 80° C. Illustrative of simple carboxylate anions of this type are trichloroacetate, cyanoacetate, beta-ketoacetate and tribromoacetate anions. Polybasic carboxylate anions, such as oxalacetate can also be employed. Activator-stabilizer precursors having carboxalate anions of this type are disclosed by Dickerson et al. U.S. Pat. No. 4,012,260, cited above, here incorporated by reference.

In one preferred form A is an alpha-sulfonylacetate, such as represented by the formula:

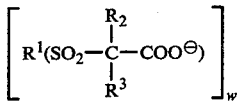

(VIII)

wherein w is 1 or 2; $R^1$ is alkyl, such as alkyl containing 1 to 6 carbon atoms, including methyl, ethyl, propyl, and butyl; aryl, such as aryl containing 6 to 10 carbon atoms, including phenyl, naphthyl and pyridyl; or carboxymethyl when w is 1 and alkylene containing 1 to 6 carbon atoms, such as methylene, ethylene and propylene, alkylidene, such as ethylidene and isopropylidene, or arylene, especially arylene containing 6 to 10 carbon atoms, such as phenylene and phenylethylidene, when w is 2; and $R^2$ and $R^3$ may be the same or different and individually represent hydrogen, alkyl containing 1 to 6 carbons, or aryl, such as aryl containing 6 to 10 carbon atoms, including phenyl.

Particularly useful alpha-sulfonylacetates include ethylenebis(sulfonylacetate), methylenebis(sulfonylacetate) and phenylsulfonylacetate. Activator precursors containing alpha-sulfonylacetates are more fully discussed in Merkel et al. U.S. Ser. No. 712,459, now U.S. Pat. No. 4,060,420, cited above, here incorporated by reference.

In another preferred form A is a 2-carboxycarboxamide, such as represented by the formula:

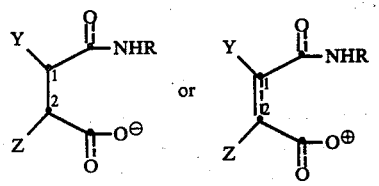

(IX)

wherein Y and Z are each selected from the group consisting of hydrogen and alkyl, especially alkyl containing 1 to 4 carbon atoms, such as methyl, ethyl, propyl and butyl, or Y and Z together represent the atoms necessary to complete a phenylene group; R is selected from the group consisting of hydrogen, alkyl containing 1 to 10 carbon atoms, such as methyl, ethyl, propyl, butyl and hexyl, and carboxamido, especially

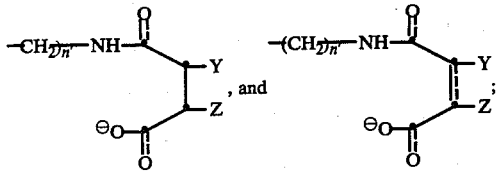

and n' is 1 to 6.

In relation to Formulas VIII and IX, alkyl, alkylene and phenylene are intended to include alkyl, alkylene and phenylene that are unsubstituted or contain substituents which do not adversely affect the sensitometric or other desired properties of the heat developable photographic material as described. Suitable substituent groups include, for example, hydroxyl, carboxamido and carbamoyl.

Activator precursors containing 2-carboxycarboxylates are more fully discussed in commonly assigned Merkel U.S. Ser. No. 753,236, cited above, here incorporated by reference.

Q can be any of a variety of protohated basic nitrogen containing moieties which do not significantly adversely affect the desired properties, such as sensitometric properties, of the described photographic materials. Preferably Q is selected from the group consisting of the following formulas:

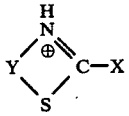

(X)

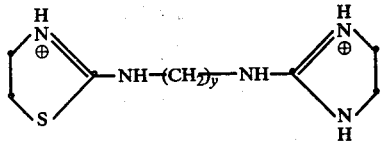

(XI)

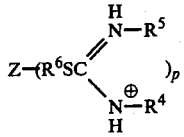

(XII)

wherein

Y is alkylene containing 2 or 3 chain carbons, such as $-CH_2-CH_2-$, $-CH_2CH_2CH_2-$, $-CH_2CH_2\overset{CH_3}{\overset{|}{C}}H-$ or $-\underset{C_6H_{11}}{\underset{|}{C}}H-CH_2-$;

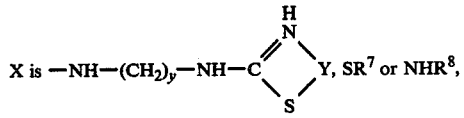

wherein $R^7$ is aminoalkyl containing 2 to 6 carbon atoms, such as aminoethyl, aminopropyl or aminobutyl;

$R^8$ is hydrogen, alkyl containing 1 to 20 carbon atoms, such as methyl, ethyl, butyl, cyclohexylmethyl, dodecyl and nonadecyl, preferably 1 to 12 carbon atoms; or phenyl; and aminoalkyl, such as aminoalkyl containing 2 to 6 carbon atoms, such as aminoethyl and aminopropyl;

p is 1 or 2;

when p is 1, Z is chosen from substituents that render the stabilizer nonvolatile and odorless, including

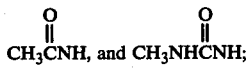

when p is 2, Z is a divalent linking group selected from groups such as

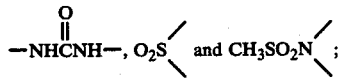

$R^6$ is alkylene containing 2 to 12 carbon atoms, such as ethylene or propylene, or phenylene;

$R^5$ and $R^4$ can be the same or different and are individually selected from the group consisting of hydrogen, alkyl, such as alkyl containing 1 to 6 carbon atoms, for example, methyl, ethyl and butyl; or $R^5$ and $R^4$ taken together represent alkylene containing 2 or 3 carbons; and y is 1 to 8.

Exemplary of preferred activator-stabilizer precursors are the following:

AS-1 bis(2-amino-2-thiazolinium)oxalacetate
AS-2 2-amino-2-thiazolinium tribromoacetate
AS-3 2-amino-2-thiazolinium cyanoacetate
AS-4 2-amino-5-bromomethyl-2-thiazolinium trichloroacetate
AS-5 2-amino-2-thiazolinium trichloroacetate

AS-6

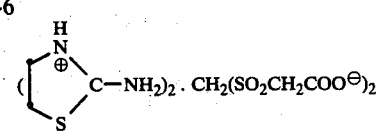

AS-7

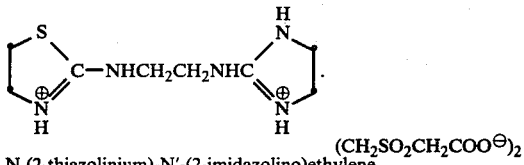

N-(2-thiazolinium)-N'-(2-imidazolino)ethylene diamine ethylenebis(sulfonylacetate)

AS-8

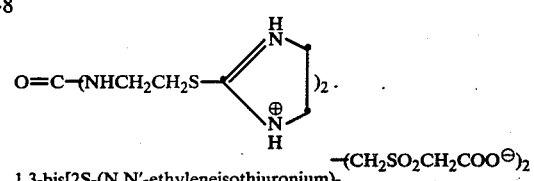

1,3-bis[2S-(N,N'-ethyleneisothiuronium)-ethyl]urea ethylenebis(sulfonylacetic acid)

AS-9

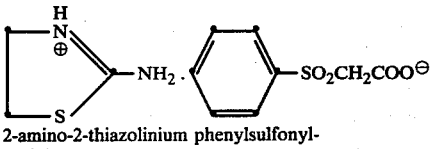

2-amino-2-thiazolinium phenylsulfonylacetate

AS-10

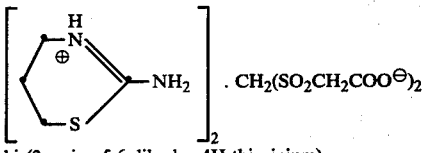

bis(2-amino-5,6-dihydro-4H-thiazinium) methylenebis(sulfonylacetate)

AS-11 2-benzylamino-2-thiazolinium phenylsulfonylacetate

AS-12 bis(2-amino-2-thiazolinium) isopropylidenebis(sulfonylacetate)

AS-13 β,β'-methylsulfonyliminobis(2-ethylthio-2-imidazolinium) methylenebis(sulfonylacetate)

AS-14 1,3-bis(2-amino-2-thiazolinium)propane ethylenebis(sulfonylacetate)

AS-15 N-(2-thiazolinium)-N'-(2-imidazolinium)-butylenediamine ethylenebis(sulfonylacetate)

AS-16 1,3-bis(2-amino-2-thiazolinium)propane N,N-ethylenebis(phthalamic acid)

AS-17 1,4-bis(2-amino-2-thiazolinium)butane N,N-hexamethylenebis(succinamic acid)

The above-described activator-stabilizer precursors are merely exemplary of preferred conventional activators which can be employed in the practice of this invention. It is appreciated that other conventional activator precursors, whether or not they include a stabilizer precursor, and stabilizer precursors can be employed. For example, stabilizers, such as those described in U.S. Pat. No. 3,669,670 of Haist and Humphlett, issued June 13, 1972, and halogen-containing stabilizer precursors (e.g., tetrabromobutane or 2-tribromomethylsulfonylbenzothiazole) can be employed in combination with the activator precursors, if desired.

The activator precursors (including activator-stabilizer precursors) and stabilizer precursors can be introduced into the hydrophilic colloid to be coated by conventional procedures. For example, these compounds can be introduced into the hydrophilic colloid to be coated before, during or after the hydrophobe loaded latex polymer particles are introduced. The described activator precursors, especially the activator-stabilizer precursors, can be preformed as described or can be formed in situ merely by mixing the acid and base portions in the presence of a solvent (e.g., water) and a vehicle.

Photographic Elements

The photographic elements of this invention are comprised of any conventional support for a photothermographic element having coated thereon at least one hydrophilic colloid layer containing the activator precursor and the hydrophobe loaded polymer particles. In addition, in the same hydrophilic colloid layer or in an adjacent hydrophilic colloid layer radiation-sensitive silver halide grains are present. In other words, either the hydrophilic colloid layer in which the activator precursor and loaded latex polymer particles are present or the adjacent hydrophilic colloid layer is a silver halide emulsion layer. The silver halide emulsion layer preferably contains both the activator precursor and the hydrophobic developing agent loaded in the polymer particles. If the activator precursor and the hydrophobe are in an adjacent hydrophilic colloid layer, it is preferably a contiguous layer. This contiguous location insures the desired interaction between the photographic silver halide and the activator precursor and developinge agent upon thermal processing. The term "reactive association" as employed herein is intended to mean that the activator precursor, developing agent and photographic silver halide are located to permit the desired interaction. Except for the presence in a single hydrophilic colloid layer of both the activator precursor and the loaded latex particles in the concentrations and of the characteristics described above, the photographic elements can be of conventional constructions.

Useful photographic silver halides include, for example, silver chloride, silver bromide, silver bromoiodide, silver chlorobromoiodide or mixtures thereof. The photographic silver halide can be coarse or fine-grain. The composition containing the photographic silver halide can be prepared by any of the well known procedures in the photographic art such as single-jet emulsions, double-jet emulsions, such as Lippman emulsions, ammoniacal emulsions, thiocyanate or thioether ripened emulsions and the like such as described in U.S. Pat. No. 2,222,264 of Nietz et al., issued Nov. 14, 1940; U.S. Pat. No. 3,332,069 of Illingsworth, issued May 15, 1967 and U.S. Pat. No. 3,271,157 of McBride, issued Sept. 6, 1966. Surface image silver halide materials can be useful or internal image silver halide material such as those described in U.S. Pat. No. 2,592,250 of Davey et al., issued Apr. 8, 1952; U.S. Pat. No. 3,206,313 of Porter et al., issued Sept. 14, 1965; U.S. Pat. No. 3,367,778 of Berriman et al., issued Feb. 6, 1968 and U.S. Pat. No. 3,447,927 of Bacon et al., issued June 3, 1969. If desired, mixtures of surface image and internal image silver halide materials can be useful as described in U.S. Pat. No. 2,996,382 of Luckey et al., issued Apr. 15, 1961. Silver halide materials useful can be regular gain silver halide materials such as the type described in Klein and Moisar, "Journal of Photographic Science," Volume 12, Number 5, September-October, 1964, pages 242–251 and German Pat. No. 2,107,118. Negative type silver halide materials can be useful as well as direct positive silver halide materials. The activator-stabilizer precursors of the present invention are particularly useful with silver bromide, silver bromoiodide and silver chloride containing emulsions. A range of concentration of photographic silver salt can be used in the photographic materials of the invention. Typically a concentration of photographic silver salt is used that, when coated on a support, provides a photographic element containing about 1 to about 30 mg Ag/dm$^2$.

It is useful in some instances to include a development restrainer in the described photographic materials according to the invention in order to provide improved image discrimination. A development restrainer, as described herein, is intended to mean a compound which reduces development on fog centers producing lower $D_{min}$ values. Useful development restrainers include, for example, 1-methyl-3-[2-(methylcarbamoylthio)ethyl]urea and bromide ion. A range of concentration of development restrainer can be useful in the described photographic material. Typically, a concentration of development restrainer is used, that is, within the range of about 0.01 to 0.2 mole of development restrainer per mole of silver in the photographic material. The optimum concentration of development restrainer can be determined based on a variety of factors, such as the particular photographic material, desired image, processing conditions, particular components of the photographic material and the like.

A photographic element, as described, can be prepared by coating the described materials on a suitable support to provide a heat developable photographic element. Any of the coating methods and means known in the photographic art can be useful for coating the described photographic materials on a suitable support. If desired, the described photographic element according to the invention can contain two or more layers. These layers, if desired, can be coated simultaneously using procedures known in the photographic art.

The silver halide photographic materials, as described, can be washed or unwashed to remove soluble salts after precipitation of the silver halide. The silver halide can be chemically sensitized; can contain development modifiers that function as speed-increasing compounds; and can contain antifoggants and emulsion stabilizers, as described in the *Product Licensing Index*, Volume 92, publication 9232, cited above.

The photographic materials, as described, can also contain hardeners, antistatic layers, plasticizers, lubricants, coating aids, matting agents, brighteners, and absorbing and filter dyes which do not adversely affect the properties of the heat developable materials of the invention. These addenda are described, for example, in the above *Product Licensing Index* publication.

The photographic and other layers of a photographic element, as described, can be coated on a variety of supports. It is necessary that the support be able to withstand the described processing temperatures without adversely affecting the described desired properties of the photographic material. Typical supports include those which can withstand processing temperatures above about 250° C. Useful supports include, for example, poly(vinyl acetal) film, poly(ethylene terephthalate) film, polycarbonate film and related films and resinous materials as well as glass, paper, metal and the like. Typically a flexible support is employed, especially a paper support.

The photographic materials of the invention can contain spectral sensitizing dyes to confer additional sensitivity to the light-sensitive silver salts, especially light-sensitive silver halide as described. Useful spectral sensitizing dyes are described, for example, in the above *Product Licensing Index* publication. Combinations of spectral sensitizing dyes can be useful if desired. In addition, supersensitizing addenda which do not absorb visible light can be useful in the described materials.

The spectral sensitizing dyes and other addenda useful in photographic materials according to the invention can be incorporated into these materials from aqueous compositions, such as water solutions, or suitable organic solvent compositions, such as organic solvent solutions. The sensitizing dyes and other addenda can be added using a variety of procedures known in the photographic art, such as described in the above *Product Licensing Index* publication.

After exposure of a photographic material according to the invention to provide a developable image in the photographic material, the resulting image can be developed and, if desired, stabilized, by merely heating the element to a temperature within the range of about 120° C. to about 200° C., usually within the range of about 150° C. to about 180° C., until the desired image is developed. In the case of a photographic material containing the described activator-stabilizer precursor, the element can be heated until the desired image is developed and stabilized. An image is typically developed by heating the described material to the described temperature for about 1 to about 60 seconds, such as about 1 to about 30 seconds. By increasing or decreasing the time of heating, a higher or lower temperature within the described range is useful.

A variety of imagewise exposure means and energy sources can be useful for providing a latent image in the described photographic material before heating. The exposure means can be, for example, a light source, a laser, an electron beam, x-rays and the like.

Processing is typically carried out under ambient conditions of pressure and humidity. Pressures and humidity outside normal atmospheric conditions can be useful, if desired; however, normal atmospheric conditions are preferred.

A variety of means is useful for providing the necessary heating, as described. The photographic element, according to the invention, can be brought into contact with a simple hot plate, heated iron, rollers, dielectric heating means or the like.

The following examples are included to further illustrate the invention:

EXAMPLE 1

To 40 ml of the latex L-1 containing 16.8% by weight solids dispersed in water were added 2 ml of a 10% by weight aqueous solution of a nonylphenoxypolyglycidol surfactant. This latex composition was added to 3.0 grams of the developing agent H-1 dissolved in 20 ml of methanol to initiate loading of the hydrophobic developing agent in the latex polymer particles. A 1.5 ml portion of the dispersion was then blended with 0.6 gram of the activator-stabilizer AS-5, 0.3 ml of the 10% by weight surfactant solution identified above, 2.45 ml of methanol and 0.75 ml of a gelatino-silver halide emulsion containing 70 mg of silver, wherein the silver halide grains have a mean diameter of 0.09 micron. This composition was coated on a photographic paper support at a coating density of approximately 7.5 mgAg/dm$^2$.

Samples of the element were sensitometrically exposed through a step tablet to produce a developable latent image, and the exposed samples were thermally processed within the temperature range of from 130° to 200° C. for 10 seconds.

No coagulation of the hydrophobe-loaded latex polymer particles was observed in the course of blending the loaded latex composition with the silver halide emulsion containing the activator-stabilizer precursor. The photographic elements exhibited satisfactory photographic properties, and no stain was observed in the elements of the completion of processing. Quantitative properties of the photographic element are summarized in Table I.

To compare stability of the photographic element with similar elements in which the developing agent was incorporated directly in gelatin rather than being loaded into latex particles samples of the photographic element and the control were placed in a black envelope after coating and before exposure. The envelope was maintained at 38° C. and 50% relative humidity. Examination of samples at the end of 1, 4, 7 and 12 days showed that in no instance did the maximum density obtainable with the samples according to this example exhibit any loss in value. By comparison the control samples showed a loss of maximum density as compared with that obtained with a fresh sample of 10%, 60%, 80% and 100% at the end of the first, fourth, seventh and twelveth day, respectively. Thus, it is apparent that the loading of the developing agent in the latex particles exhibited a marked improvement in stability.

(roughly within the range of ±10%), but this was not viewed as significantly influencing the results obtained.

EXAMPLES 14 AND 15

Examples 1 and 2 were repeated, but with the substitution of a poly(ethylene terephthalate) film support for the photographic paper support. While a significant decrease in maximum density was observed, the photographic elements were otherwise generally similar to those of Examples 1 and 2. The results are summarized in Table I.

EXAMPLES 16 THROUGH 28 (COMPARATIVE EXAMPLES)

Attempts were made to repeat Example 1 substituting latexes wherein the polymer particles lacked repeating units which are cationically ionizable. In each instance unacceptable clumping of the latex particles occurred. We were unable to obtain uniform coatings, and it was apparent to us that no satisfactory photographic performance could be obtained. On the other hand, when we coated the activator-stabilizer and the latex particles having the developing agent loaded therein in separate layers, no clumping was observed, and satisfactory photographic performance was obtained. Thus, it was apparent that it was the incompatibility of the latex polymer particles and the activator-stabilizer that prevented obtaining satisfactory results when both the polymer and activator-stabilizer were coated in a single layer. The polymers lacking cationically ionizable repeating units which were employed are listed in Table II. The weight percentage of solids ranged from 9.5 to 17.9% in the latex before loading.

TABLE I

| Example No. | Latex | Developer | Activator Precursor | Weight Ratio Dev./Latex Polymer | Density max | Density min | Mole Ratio Dev./Ag | Silver Coverage (mg/dm$^2$) |
|---|---|---|---|---|---|---|---|---|
| 1 | L-1 | H-1 | AS-5 | 0.44/1.0 | 1.60 | 0.08 | 0.57/1.0 | 7.5 |
| 2 | L-2 | H-1 | AS-5 | 0.47/1.0 | 1.58 | 0.08 | 0.57/1.0 | 7.5 |
| 3 | L-2 | H-2 | AS-5 | 0.53/1.0 | 1.62 | 0.32 | 0.37/1.0 | 7.5 |
| 4 | L-2 | H-5 | AS-5 | 0.70/1.0 | 1.46 | 0.46 | 0.58/1.0 | 7.5 |
| 5 | L-2 | H-7 | AS-5 | 0.70/1.0 | 1.20 | 0.40 | 0.54/1.0 | 7.5 |
| 6 | L-2 | H-6 | AS-5 | 0.63/1.0 | 1.52 | 0.75 | 0.58/1.0 | 7.5 |
| 7 | L-2 | H-8 | AS-5 | 0.81/1.0 | 0.98 | 0.17 | 0.58/1.0 | 7.5 |
| 8 | L-2 | H-9 | AS-5 | 0.47/1.0 | 1.52 | 0.08 | 0.58/1.0 | 7.5 |
| 9 | L-2 | H-3 | AS-5 | 0.47/1.0 | 1.26 | 0.24 | 0.52/1.0 | 7.5 |
| 10 | L-2 | H-4 | AS-5 | 0.90/1.0 | 1.24 | 0.09 | 0.58/1.0 | 7.5 |
| 11 | L-3 | H-1 | AS-5 | 0.47/1.0 | 1.57 | 0.09 | 0.58/1.0 | 7.5 |
| 12 | L-1 | H-1 | AS-5 | 0.44/1.0 | 1.46 | 0.08 | 0.58/1.0 | 4.6 |
| 13 | L-2 | H-1 | AS-5 | 0.47/1.0 | 1.42 | 0.08 | 0.58/1.0 | 4.6 |
| 14 | L-1 | H-1 | AS-5 | 0.44/1.0 | 0.64 | 0.08 | 0.58/1.0 | 7.5 |
| 15 | L-2 | H-1 | AS-5 | 0.47/1.0 | 0.71 | 0.08 | 0.58/1.0 | 7.5 |
| 43 | L-1 | H-1 | AS-6 | 0.44/1.0 | 1.63 | 0.28 | 0.58/1.0 | 7.5 |
| 44 | L-2 | H-1 | AS-6 | 0.50/1.0 | 1.65 | 0.38 | 0.58/1.0 | 7.5 |
| 45 | L-3 | H-1 | AS-6 | 0.47/1.0 | 1.65 | 0.38 | 0.58/1.0 | 7.5 |
| 46 | L-3 | H-1 | AS-6 | 0.47/1.0 | 1.60 | 0.21 | 0.58/1.0 | 7.5 |
| 47 | L-3 | H-1 | AS-6 | 0.47/1.0 | 1.50 | 0.16 | 0.58/1.0 | 7.5 |
| 48 | L-3 | H-1 | AS-6 | 0.47/1.0 | 1.58 | 0.12 | 0.58/1.0 | 7.5 |
| 49 | L-3 | H-13 | AS-6 | 0.50/1.0 | 1.40 | 0.50 | 0.58/1.0 | 7.5 |
| 50 | L-3 | H-14 | AS-6 | 0.50/1.0 | 1.60 | 0.50 | 0.58/1.0 | 7.5 |
| 51 | L-3 | H-15 | AS-6 | 0.50/1.0 | 1.60 | 0.50 | 0.58/1.0 | 7.5 |
| 52 | L-3 | H-16 | AS-6 | 0.50/1.0 | 1.60 | 0.50 | 0.58/1.0 | 7.5 |
| 53 | L-3 | H-17 | AS-6 | 0.50/1.0 | 1.70 | 0.50 | 0.58/1.0 | 7.5 |
| 54 | L-5 | H-1 | AS-6 | 0.50/1.0 | 1.62 | 0.08 | 0.58/1.0 | 7.5 |
| 55 | L-6 | H-1 | AS-6 | 0.50/1.0 | 1.65 | 0.12 | 0.58/1.0 | 7.5 |
| 56 | L-4 | H-1 | AS-6 | 0.50/1.0 | 1.66 | 0.14 | 0.58/1.0 | 7.5 |
| 57 | L-8 | H-1 | AS-6 | 0.50/1.0 | 1.60 | 0.08 | 0.58/1.0 | 7.5 |
| 58 | L-9 | H-1 | AS-6 | 0.50/1.0 | 1.60 | 0.08 | 0.58/1.0 | 7.5 |

EXAMPLES 2 THROUGH 13

Example 1 was repeated varying the latex composition, the developer and the silver coverage as indicated in Table I, wherein the results are summarized. The percentage solids in the latexes varied somewhat

TABLE II

| Example No. | Latex |
|---|---|
| 16 | Poly(butyl acrylate-co-3-methacryloyloxypropane-1-sulfonic acid, sodium salt-co-2-acetoxyethyl methacrylate) (Weight ratio 85/10/5) |
| 17 | Poly(butyl methacrylate-co-methacryloyloxypropane-1-sulfonic acid, sodium salt-co-2-acetoacetoxyethyl methacrylate) (Weight ratio 85/10/5) |
| 18 | Poly(ethyl acrylate-co-3-methacryloyloxypropane-1-sulfonic acid, sodium salt-co-2-aceto- |

TABLE II-continued

| Example No. | Latex |
|---|---|
| | acetoxyethyl methacrylate) (Weight ratio 85/10/5) |
| 19 | Poly(methyl acrylate-co-3-methacroyloxypropane-1-sulfonic acid, sodium salt-co-2-aceto-acetoxyethyl methacrylate) (Weight ratio 85/10/5) |
| 20 | Poly(butyl acrylate-co-3-methacryloyloxypropanel-sulfonic acid, sodium salt) (Weight ratio 85/15) |
| 21 | Poly(butyl methacrylate-co-methyl methacrylate-co-3-methacryloyloxypropane-1-sulfonic acid, sodium salt-co-2-acetoacetoxyethyl methacrylate) (Weight ratio 70/15/10/5) |
| 22 | Poly(butyl acrylate-co-methyl methacrylate-co-3-methacryloyloxypropane-1-sulfonic acid, sodium salt) (Weight ratio 70/10/20) |
| 23 | Poly(butyl acrylate-co-2-acrylamido-2-methylpropane sulfonic acid-co-2-acetoacetoxyethyl methacrylate) (Weight ratio 85/10/5) |
| 24 | Poly(butyl methacrylate-co-2-acrylamido-2-methylpropane sulfonic acid-2-acetoacetoxyethyl methacrylate) (Weight ratio 85/10/5) |
| 25 | Poly(propyl acrylate-co-2-acrylamido-2-methylpropane sulfonic acid-co-2-acetoacetoxyethyl methacrylate) (Weight 85/10/5) |
| 26 | Poly(methyl acrylate-co-2-acrylamido-2-methylpropane sulfonic acid-co-2-acetoacetoxyethyl methacrylate) (Weight ratio 85/10/5) |
| 27 | Poly(butyl acrylate-co-acrylamide-2-acetoacetoxyethyl methacrylate) (Weight ratio 70/25/5) |
| 28 | Poly(butyl methacrylate-co-styrene-co-2-acrylamido-2-methylpropane sulfonic acid) (Weight ratio 50/40/10) |

EXAMPLES 29 THROUGH 41 (COMPARATIVE EXAMPLES)

A loaded latex was prepared consisting of in each instance one of the latexes of Examples 16 through 28 in a quantity of 18 ml, 1.8 ml of a 10% by weight aqueous solution of a nonylphenoxyglycidol surfactant, 60 ml of acetone, 12 ml of methanol, either 1.5 or 3.0 grams of developing agent H-1 and 30 ml of an aqueous solution of 3% gelatin and 3% hydroxypropyl cellulose. The hydroxypropyl cellulose was specifically chosen for inclusion because of known unique properties which it exhibits in an attempt to avoid the coagulation problem experienced when gelatin was used alone as a photographic vehicle.

To the loaded latex was added a solution consisting of 11.1 grams of activator-stabilizer precursor AS-5, 11.1 ml of the surfactant solution identified above and 37.9 ml of water. To the resulting mixture was then added 15.7 ml of the silver bromide emulsion employed in Example 1.

Coagulation was observed in the compositions, except those where the loaded latex polymer particles were comprised of repeating units of 3-methacryloyloxypropane-1-sulfonic acid, sodium salt. The loaded latexes formed by polymers containing these repeating units did not coagulate on blending; however, the coatings were unacceptable from a processing viewpoint in that they exhibited reticulation (cracking) upon thermal processing. The reticulation was considered to be the direct result of employing hydroxypropyl cellulose in the vehicle. When hydroxyethyl cellulose is employed as a vehicle in place of hydroxypropyl cellulose, the results are similar to those described where gelatin is the sole vehicle.

EXAMPLE 42 (A COMPARATIVE EXAMPLE)

Example 1 as repeated, but the hydrophilic developing agent 4-methyl-4-hydroxymethyl-1-phenyl-3-pyrazolidone was substituted for H-1. Whereas neutral images were obtained with the hydrophobic developing agent H-1, brownish images were obtained with the hydrophilic developing agent. Further, background staining was observed with the hydrophilic developing agent.

EXAMPLES 43 THROUGH 45

Example 1 was in each instance repeated, but with the substitution of 0.43 gram of the activator-stabilizer precursor AS-6 for 0.6 gram of activator-stabilizer precursor AS-5 and 2.45 ml of water for 2.45 ml of methanol. The latexes employed in each example are set out in Table I along with quantitative results. Each of the coatings were considered satisfactory and no coagulation of the coating composition was observed.

EXAMPLE 46

Example 45 was repeated, except that 0.5 gram of AS-6 was employed and the coating composition additionally contained 0.2 mg/dm$^2$ of sodium bromide as an antifoggant. The results are summarized in Table I.

EXAMPLE 47

Example 45 was repeated, except that 0.5 gram of AS-6 was employed and the coating composition additionally contained 2.0 mg/dm$^2$ of 5-methylbenzotriazole as an antifoggant. The results are summarized in Table I.

EXAMPLE 48

Example 45 was repeated, except that 0.5 gram of AS-6 was employed and the coating composition additionally contained 1.0 mg/dm$^2$ of $$CH_3NHC(=O)SCH_2CH_2NHC(=O)NHCH_3$$

as an antifoggrant. The results are summarized in Table I.

EXAMPLES 49 THROUGH 58

Example 43 as repeated, but with the variations noted in Table I. Satisfactory results were obtained in each instance.

The invention has been described with particular reference to preferred embodiments thereof but it will be understood that variations and modifications can be effected within the spirit and scope of the invention.

We claim:

1. A photographic element comprised of a support and, coated on the support, a hydrophilic colloid layer comprised of a hydrophilic colloid, and within the hydrophilic colloid, an activator precursor which is a compound of a protonated basic nitrogen-containing moiety and an acid anion, loaded polymer particles of from 0.02 to 0.2 micron in average diameter consisting essentially of a hydrophobic polymer of which at least 2 percent by weight is comprised of ionizable repeating units capable of forming hydrophilic homopolymers, at least half of said ionizable repeating units being cationically ionizable, and a hydrophobic developing agent loaded into and distributed through said particles, the weight ratio of said developing agent to said polymer being from about 1:4 to 3:1, in said hydrophilic colloid layer or in an adjacent hydrophilic colloid layer, radiation-sensitive silver halide grains, and said activator precursor being present in a concentration of from 1 to 4 equivalents for each mole of said radiation-sensitive silver halide, and wherein said ionizable repeating units of said hydrophobic polymer are cationically ionizable and are represented by the formula

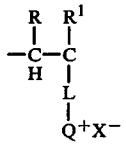

wherein,

R and $R^1$ are independently chosen from among hydrogen, alkyl and aryl groups, L is a divalent linking group and $Q^+$ is a group of the formula

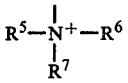

where $R^5$, $R^6$ and $R^7$ are independently chosen from the group consisting of alkyl, aryl, alkaryl and aralkyl, and $X^-$ is an anion.

2. A photograhic element according to claim 1 wherein the weight ratio of said developing agent to said polymer is from about 1:3 to 1:1.

3. A photographic element according to claim 1 wherein the loaded polymer particles are from 0.08 to 0.2 micron in average diameter.

4. A photographic element according to claim 1 wherein said hydrophilic colloid is gelatin.

5. A photographic element according to claim 1 wherein said hydrophobic developing agent is a hydrophobic reductone developing agent.

6. A photographic element according to claim 1 wherein said hydrophobic developing agent is a hydrophobic pyrazolidone developing agent.

7. A photographic element according to claim 1 wherein said hydrophobic developing agent is a hydrophobic aminophenol developing agent.

8. A photographic element according to claim 1 wherein said hydrophobic developing agent is a hydrophobic pyrroline developing agent.

9. A photographic element according to claim 1 wherein said activator precursor is an activator-stabilizer precursor.

10. A photographic element according to claim 1 wherein said activator precursor is an activator-stabilizer precursor and is represented by the formula:

$Q_mA_w$ wherein Q is a protonated basic nitrogen-containing moiety, A is a carboxylate anion and m and w are integers chosen to form neutral compound.

11. A photographic element according to claim 1 wherein said activator precursor is an activator-stabilizer precursor and is present in a concentration of from 1.2 to 2.0 equivalents per mole of said silver halide.

12. A photographic element according to claim 1 wherein said ionizable repeating units form from 2 to 30 percent by weight of said hydrophobic polymer.

13. A photographic element according to claim 1 wherein said ionizable repeating units form from 5 to 20 percent by weight of said hydrophobic polymer.

14. A photographic element comprised of a support and, coated on the support, a gelatino-silver halide emulsion layer comprised of from 1.2 to 2 equivalents per mole of silver halide of an activator-stabilizer precursor of the formula $Q_mA_w$ wherein, Q is a protonated basic nitrogen-containing moiety, A is a carboxylate anion and m and w are integers chosen to form a neutral compound, and loaded polymer particles of from 0.08 to 0.2 micron in average diameter consisting essentially of a hydrophobic polymer of which from 5 to 20 percent by weight is comprised of ionizable repeating units, at least 50 percent of which on a mole basis are cationically ionizable repeating units of the formula

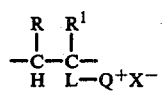

wherein,

R and $R^1$ are independently chosen from among hydrogen, alkyl of from 1 to 5 carbon atoms and aryl of from 6 to 10 carbon atoms, L is a divalent

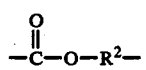

linking group where $R^2$ is a divalent alkylene group of from 1 to 5 carbon atoms and $Q^+$ is a group of the formula

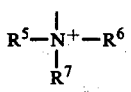

where $R^5$, $R^6$, $R^7$ are independently chosen from the group consisting of alkyl, aryl, alkaryl and aralkyl, where each said alkyl moiety contains from 1 to 5 carbon atoms and each said aryl moiety contains 6 to 10 carbon atoms, and $X^-$ is an anion, and a hydrophobic developing agent loaded into and distributed through said particles, the weight ratio of said developing agent to said polymer being from about 1:3 to 1:1.

15. A photographic elmeent according to claim 14 wherein a minor portion of said ionizable repeating units are formed from a monomer of the formula

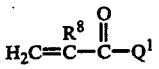

wherein $R^8$ is hydrogen, chlorine or lower alkyl of from 1 to 5 carbon atoms, $Q^1$ is OM or an organic radical which together with the carbonyl group of the formula forms an ester or amide group terminating in a hydroxy, COOM or $SO_3M$ solubilizing group; and M is hydrogen, ammonium or alkali metal.

16. A photographic element according to claim 15 wherein $R^8$ is hydrogen or methyl.

17. A photographic element according to claim 14 wherein said cationically ionizable repeating unit is derived from a protonated ammonium ester of acrylic or methacrylic acid.

18. A photographic element according to claim 14 wherein Q is a thiazolium moiety and A is a carboxylate anion which is decarboxylatable at temperatures above about 80° C.

19. A photographic element according to claim 14 wherein Q is a thiazolium moiety and A is an alpha-sulfonylacetate.

* * * * *

UNITED STATES PATENT AND TRADEMARK OFFICE

CERTIFICATE OF CORRECTION

PATENT NO. : 4,133,687

DATED : January 9, 1979

INVENTOR(S) : Tsang J. Chen and Donald F. McLaen

It is certified that error appears in the above-identified patent and that said Letters Patent are hereby corrected as shown below:

Column 5, line 36, "uints" should read ---units---.

Column 15, line 8, that part of the formula reading "methypropanesulfonic" should read ---methylpropane-sulfonic---; line 33, "methosfulate" should read ---methosulfate---.

Column 18, line 40, in the structure "$H_2C$" should read ---$H_3C$---.

Column 25, line 42, "protohated" should read ---protonated---.

Column 26, last line, below the structure insert --- bis(2-amino-2-thiazolinium)methylene bis(sulfonylacetate) ---.

Column 28, line 26, "developinge" should read ---developing---; line 60, "gain" should read ---grain---.

UNITED STATES PATENT AND TRADEMARK OFFICE

CERTIFICATE OF CORRECTION

PATENT NO. : 4,133,687

DATED : January 9, 1979

INVENTOR(S) : Tsang J. Chen and Donald F. McLaen

It is certified that error appears in the above-identified patent and that said Letters Patent are hereby corrected as shown below:

Column 33, line 57, "as" should read ---was---.

Column 34, line 53, "as" should read ---was---.

Signed and Sealed this

Fifth Day of June 1979

[SEAL]

*Attest:*

RUTH C. MASON
*Attesting Officer*

DONALD W. BANNER
*Commissioner of Patents and Trademarks*